US012618186B2

(12) United States Patent
Yoon et al.

(10) Patent No.: US 12,618,186 B2
(45) Date of Patent: May 5, 2026

(54) LAUNDRY TREATMENT APPARATUS

(71) Applicant: LG Electronics Inc., Seoul (KR)

(72) Inventors: Juhan Yoon, Seoul (KR); Yongjun An, Seoul (KR); Namyeong Heo, Seoul (KR)

(73) Assignee: LG Electronics Inc., Seoul (KR)

( * ) Notice: Subject to any disclaimer, the term of this patent is extended or adjusted under 35 U.S.C. 154(b) by 111 days.

(21) Appl. No.: 18/728,352

(22) PCT Filed: Jan. 16, 2023

(86) PCT No.: PCT/KR2023/000751

§ 371 (c)(1),
(2) Date: Jul. 11, 2024

(87) PCT Pub. No.: WO2023/136690

PCT Pub. Date: Jul. 20, 2023

(65) Prior Publication Data

US 2024/0417910 A1 Dec. 19, 2024

(30) Foreign Application Priority Data

Jan. 17, 2022 (KR) ..... 10-2022-0006790
Jan. 17, 2022 (KR) ..... 10-2022-0006791

(51) Int. Cl.
*D06F 37/40* (2006.01)
*D06F 37/22* (2006.01)
(Continued)

(52) U.S. Cl.
CPC ..... *D06F 37/40* (2013.01); *D06F 37/22* (2013.01); *D06F 37/04* (2013.01); *D06F 37/20* (2013.01);
(Continued)

(58) Field of Classification Search
CPC ..... D06F 37/40; D06F 37/42; D06F 58/08; D06F 37/206; D06F 37/22; D06F 37/304; D06F 37/04; D06F 37/20
See application file for complete search history.

(56) References Cited

U.S. PATENT DOCUMENTS

2001/0051041 A1* 12/2001 Zeh ..... D06F 37/304 388/800
2005/0076534 A1 4/2005 Ofosu-Asante et al.
(Continued)

FOREIGN PATENT DOCUMENTS

CN 1415033 A * 4/2003 ..... H02K 5/00
CN 101199098 A * 6/2008 ..... H02K 1/2791
(Continued)

OTHER PUBLICATIONS

Extended European Search Report in European Appln. No. 23740533.7, mailed on Feb. 14, 2025, 9 pages.
(Continued)

*Primary Examiner* — Benjamin L Osterhout
(74) *Attorney, Agent, or Firm* — Fish & Richardson P.C.

(57) ABSTRACT

Disclosed is a laundry treatment apparatus, including a cabinet, a drum rotatably provided in the cabinet and configured to accommodate laundry, having a cylindrical shape, having one side open so as to define an input opening, and having another side defining a drum rear plate, a driving portion having a drum rotating shaft coupled to the drum rear plate so as to provide power to rotate the drum, and a filter layer, provided at a portion where the drum rotating shaft is connected to the drum and made of a material that blocks leakage current.

20 Claims, 16 Drawing Sheets

(51) Int. Cl.

| | |
|---|---|
| *D06F 37/04* | (2006.01) |
| *D06F 37/20* | (2006.01) |
| *D06F 37/30* | (2020.01) |
| *D06F 37/42* | (2006.01) |
| *D06F 58/08* | (2006.01) |

(52) U.S. Cl.
CPC ..... *D06F 37/206* (2013.01); *D06F 37/304* (2013.01); *D06F 37/42* (2013.01); *D06F 58/08* (2013.01)

(56) References Cited

U.S. PATENT DOCUMENTS

| | | | | |
|---|---|---|---|---|
| 2008/0019065 | A1 | 1/2008 | Heyder et al. | |
| 2014/0208609 | A1 | 7/2014 | Han et al. | |
| 2016/0273147 | A1* | 9/2016 | Chiriatti | D06F 37/22 |
| 2018/0347093 | A1 | 12/2018 | Lee et al. | |

FOREIGN PATENT DOCUMENTS

| | | | | | |
|---|---|---|---|---|---|
| CN | 101314914 | A | | 12/2008 | |
| CN | 101427445 | A | * | 5/2009 | D06F 37/304 |
| CN | 101632213 | A | * | 1/2010 | H02K 1/2786 |
| CN | 101838900 | B | * | 9/2011 | D06F 37/269 |
| CN | 111576001 | A | | 8/2020 | |
| CN | 113584829 | A | | 11/2021 | |
| EP | 1950337 | B1 | | 10/2011 | |
| JP | 2007-518533 | A | | 7/2007 | |
| JP | 2008-220797 | A | | 9/2008 | |
| KR | 10-0161016 | B1 | | 12/1998 | |
| KR | 10-2007-0067219 | A | | 6/2007 | |
| KR | 20130143641 | A | * | 12/2013 | D06F 37/206 |
| KR | 101546173 | B1 | * | 8/2015 | D06F 37/40 |
| KR | 10-2017-0015190 | A | | 2/2017 | |
| WO | WO-2006078114 | A2 | * | 7/2006 | D06F 37/304 |
| WO | WO-2006080704 | A2 | * | 8/2006 | H02K 21/22 |
| WO | WO 2014/035071 | A1 | | 3/2014 | |

OTHER PUBLICATIONS

International Search Report and Written Opinion in International Appln. No. PCT/KR2023/000751, mailed on May 2, 2023, 11 pages.

Notice of Allowance in Korean Appln. No. 10-2022-0006791, mailed on May 7, 2025, 3 pages (with English translation).

* cited by examiner

[Fig. 2]
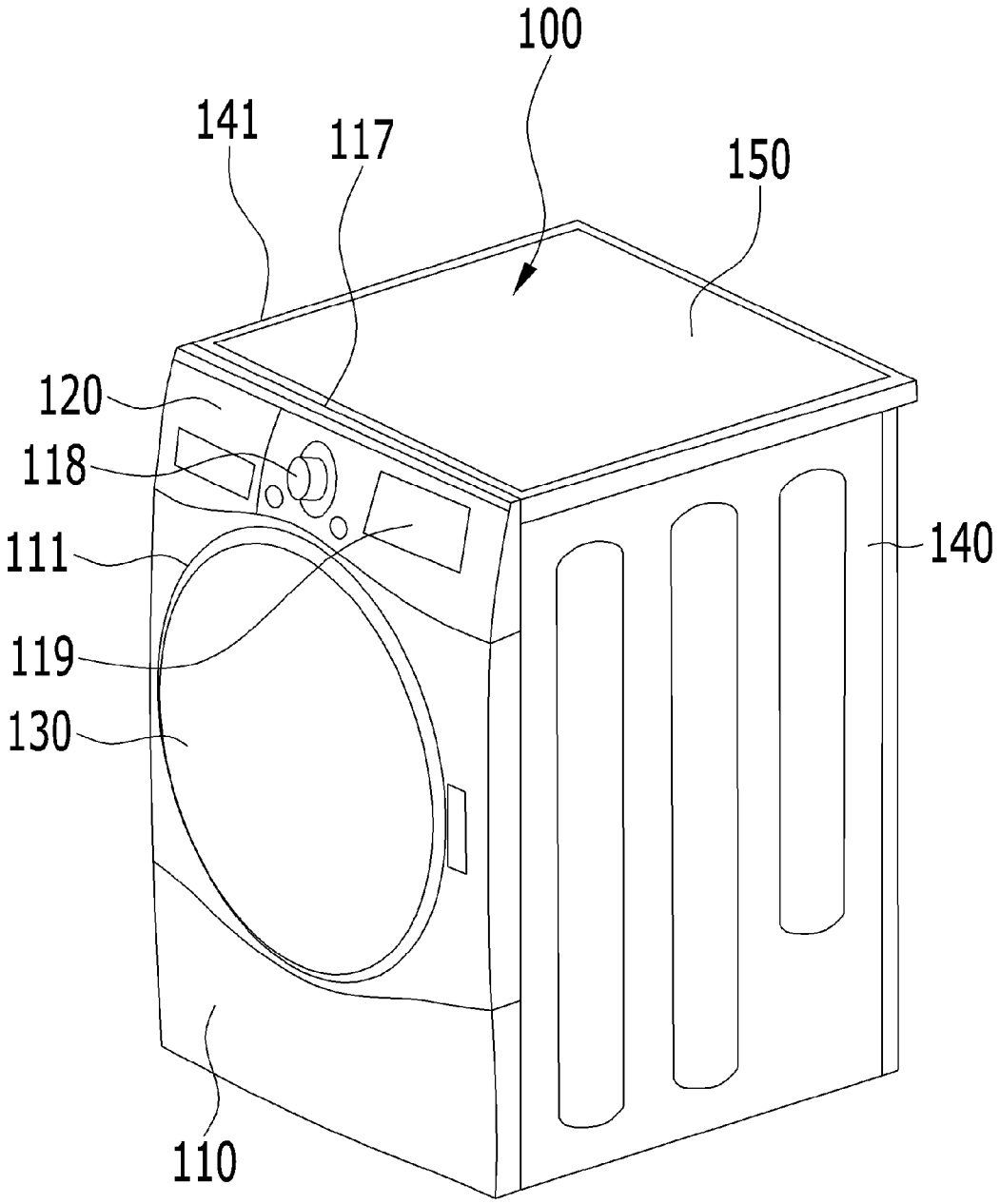

[Fig. 3]
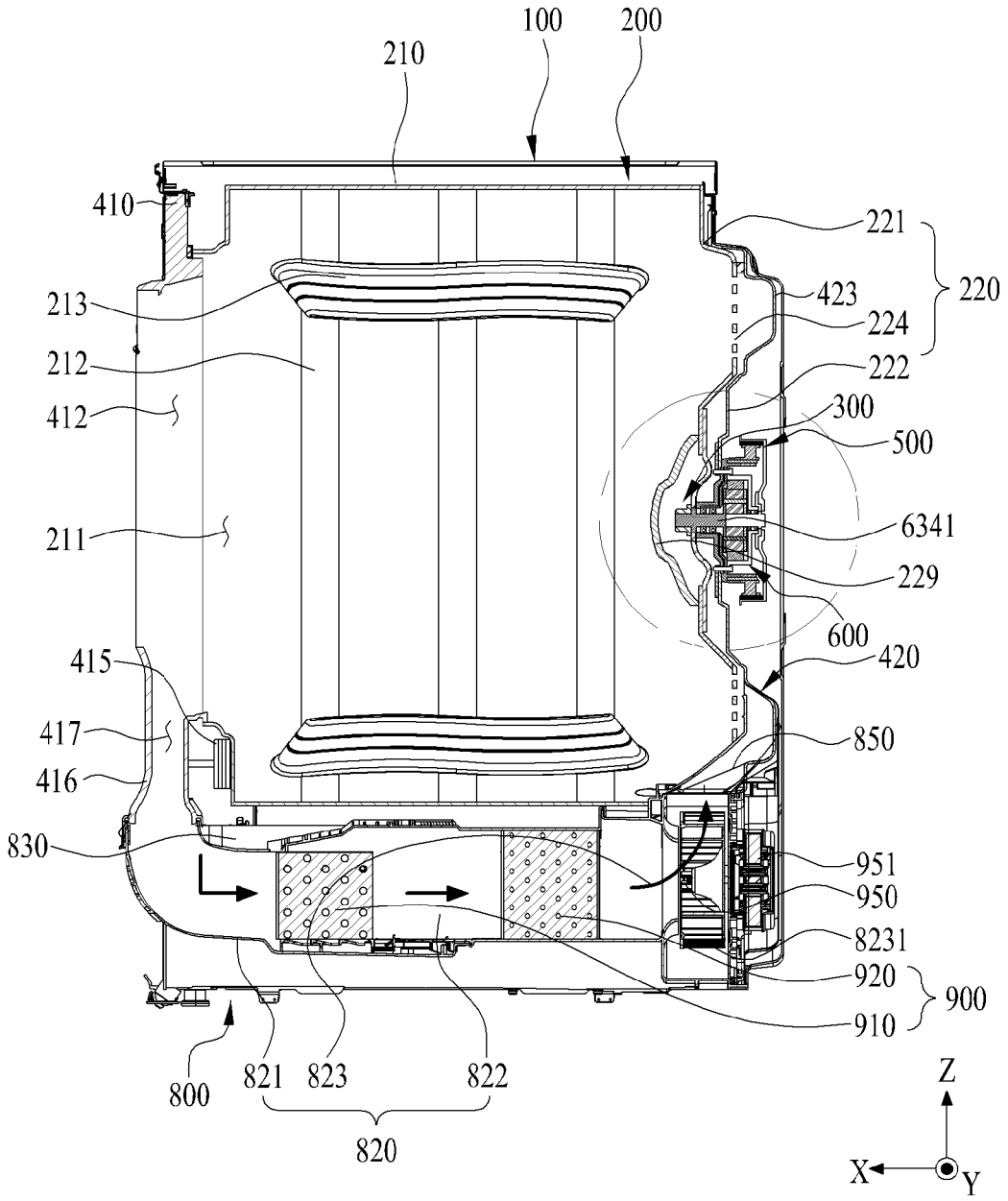

[Fig. 4]
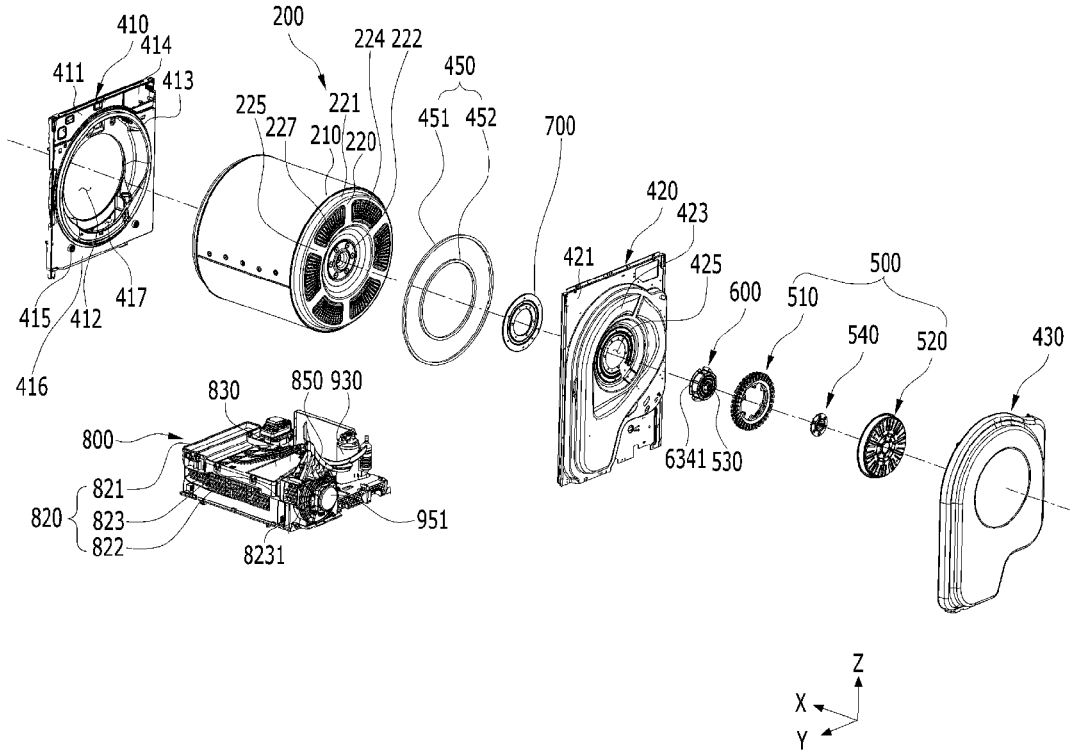
[Fig. 5A]
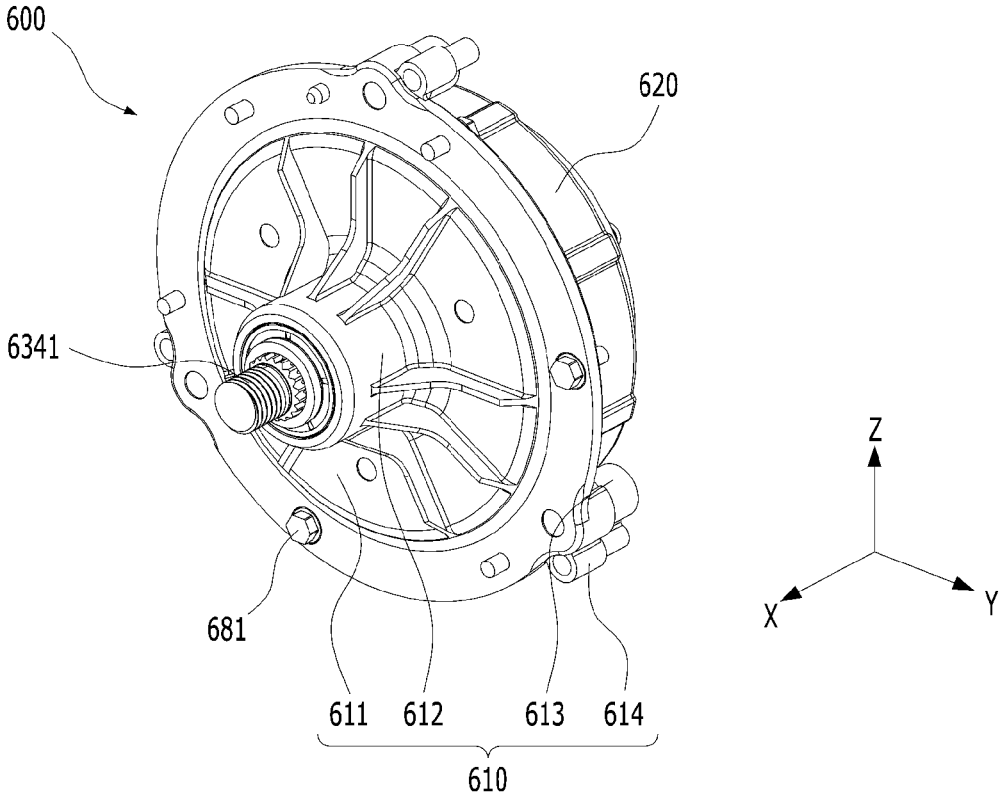

[Fig. 5B]
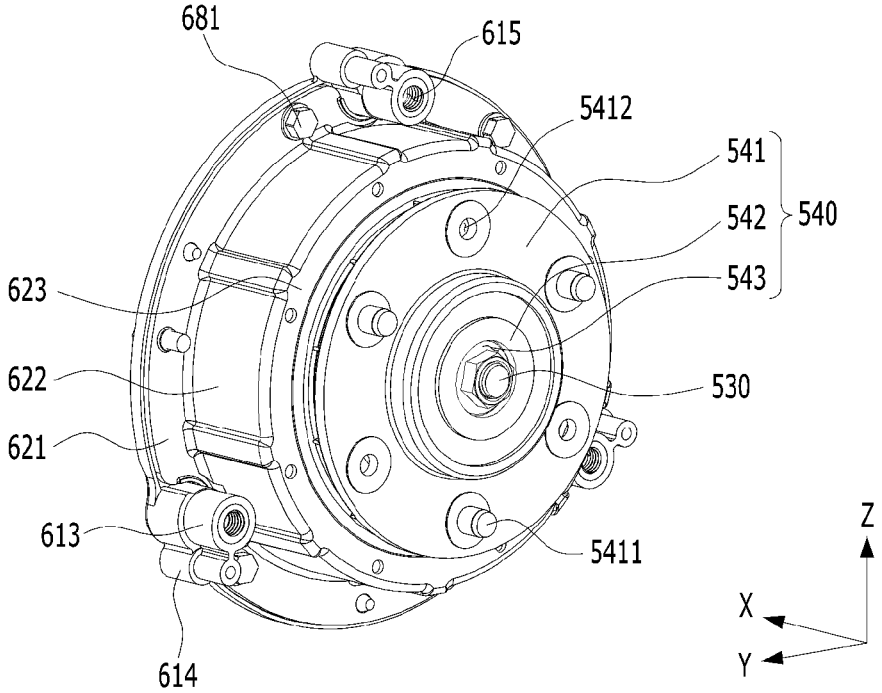

[Fig. 6]
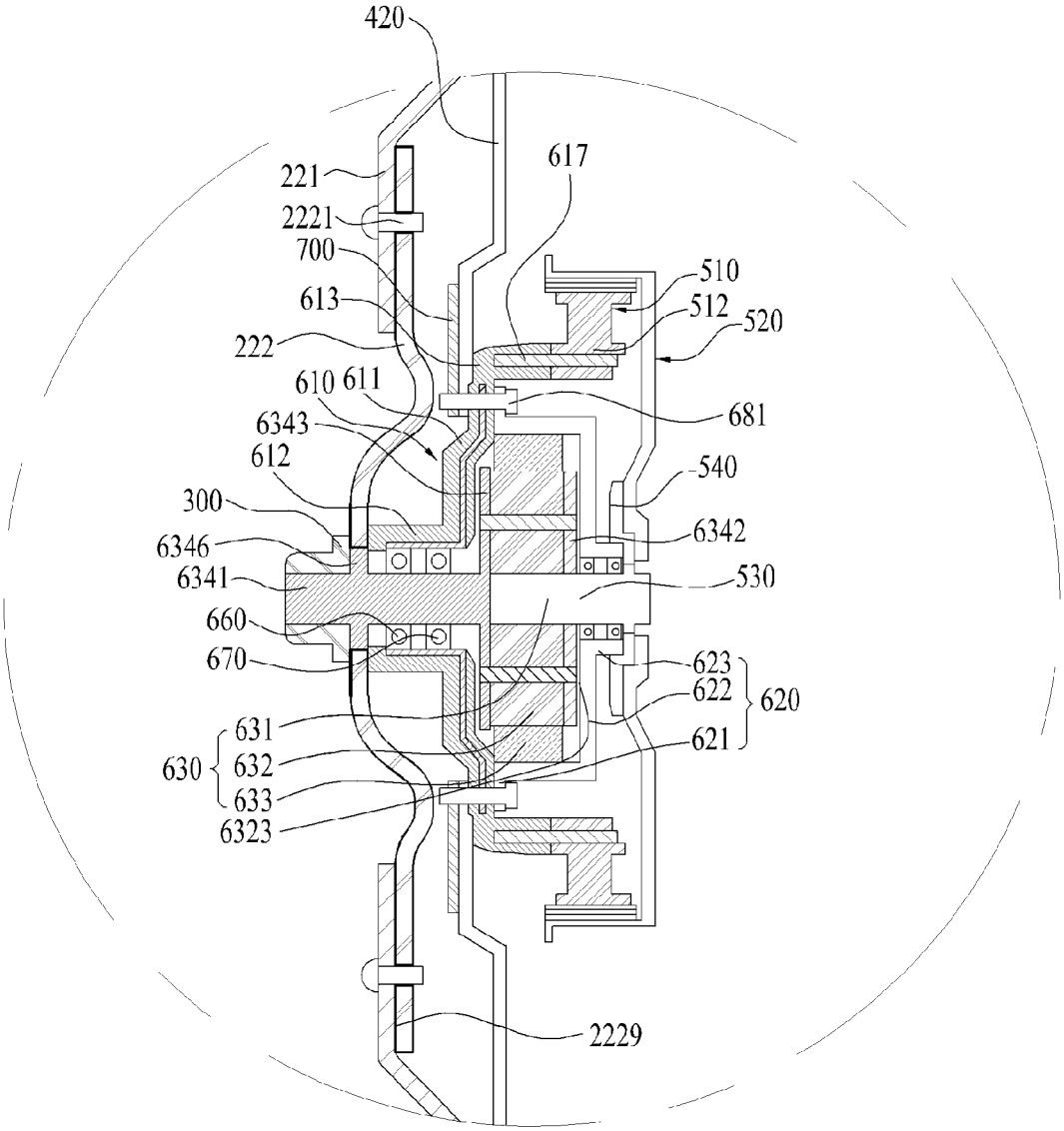

[Fig. 7A]
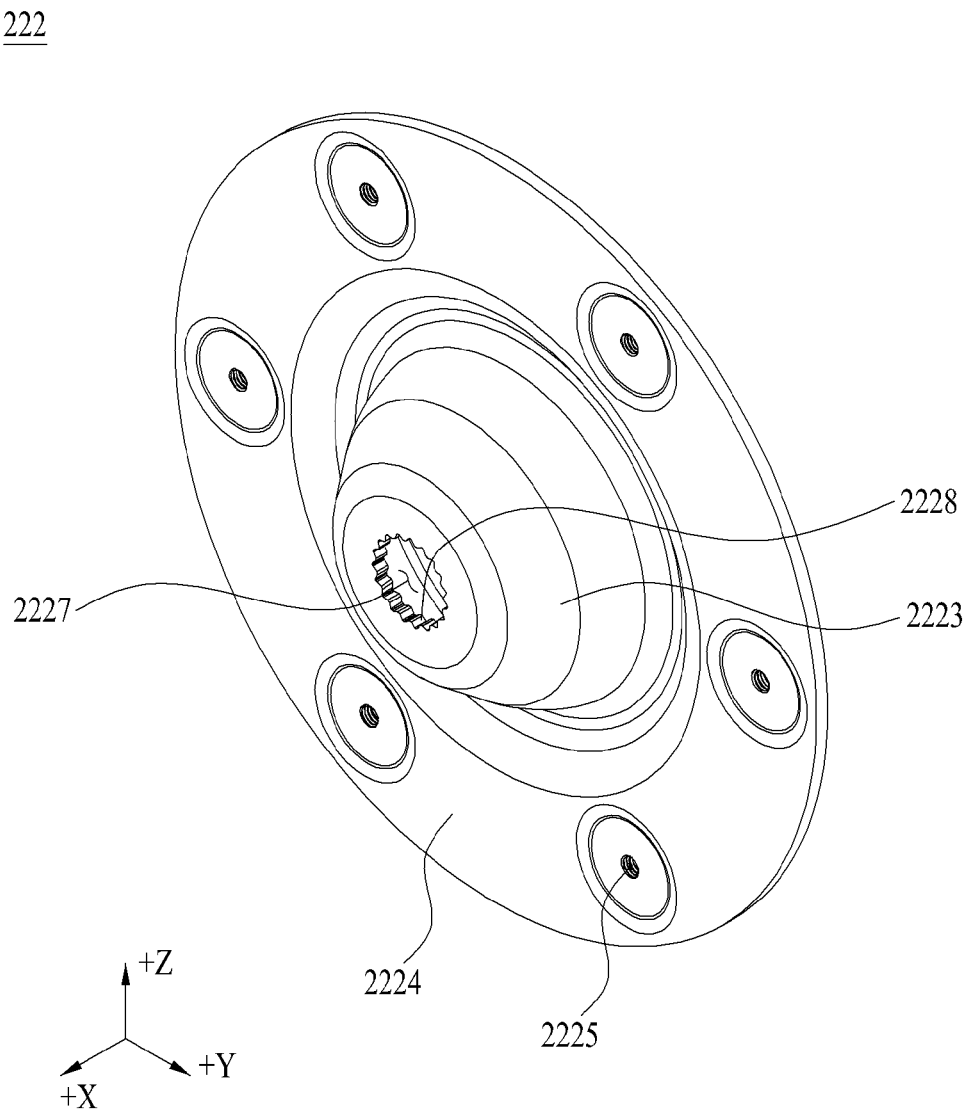

[Fig. 7B]
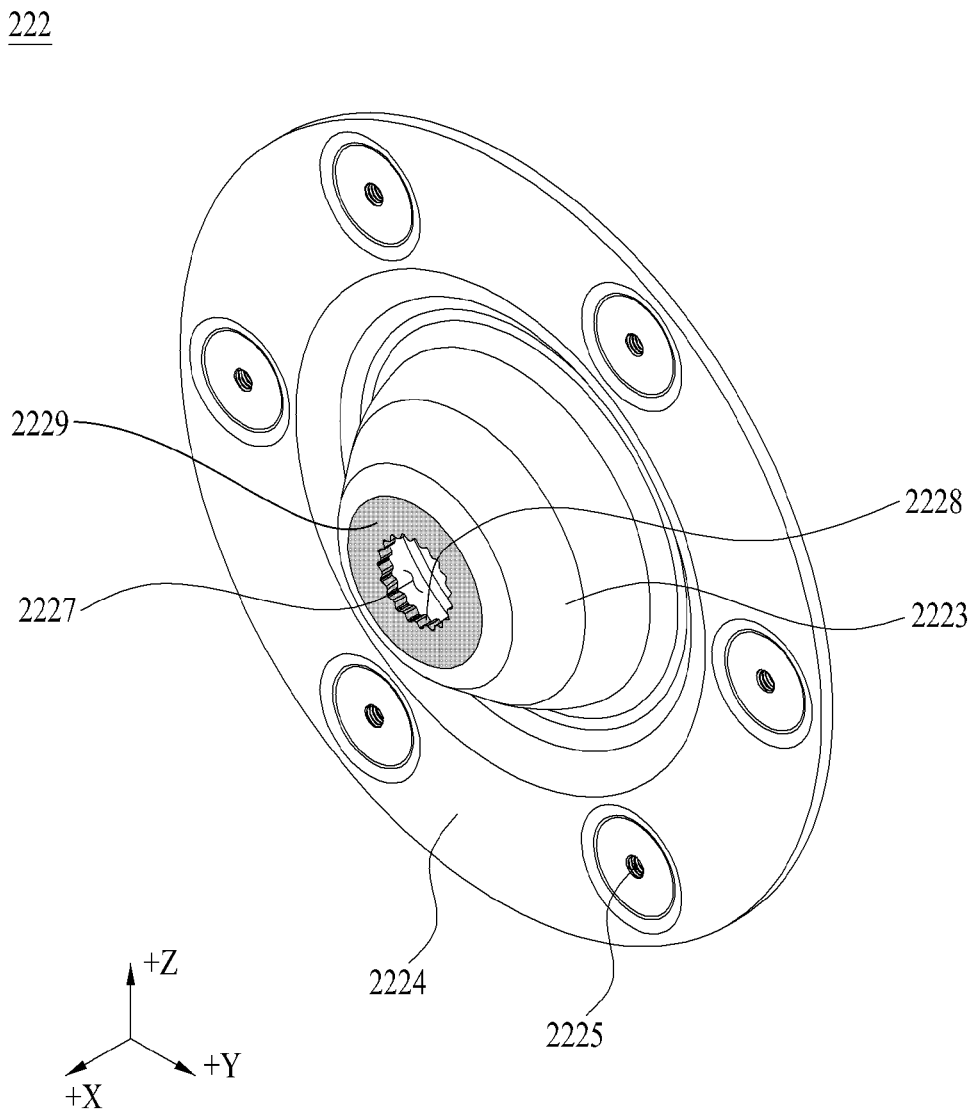

[Fig. 7C]
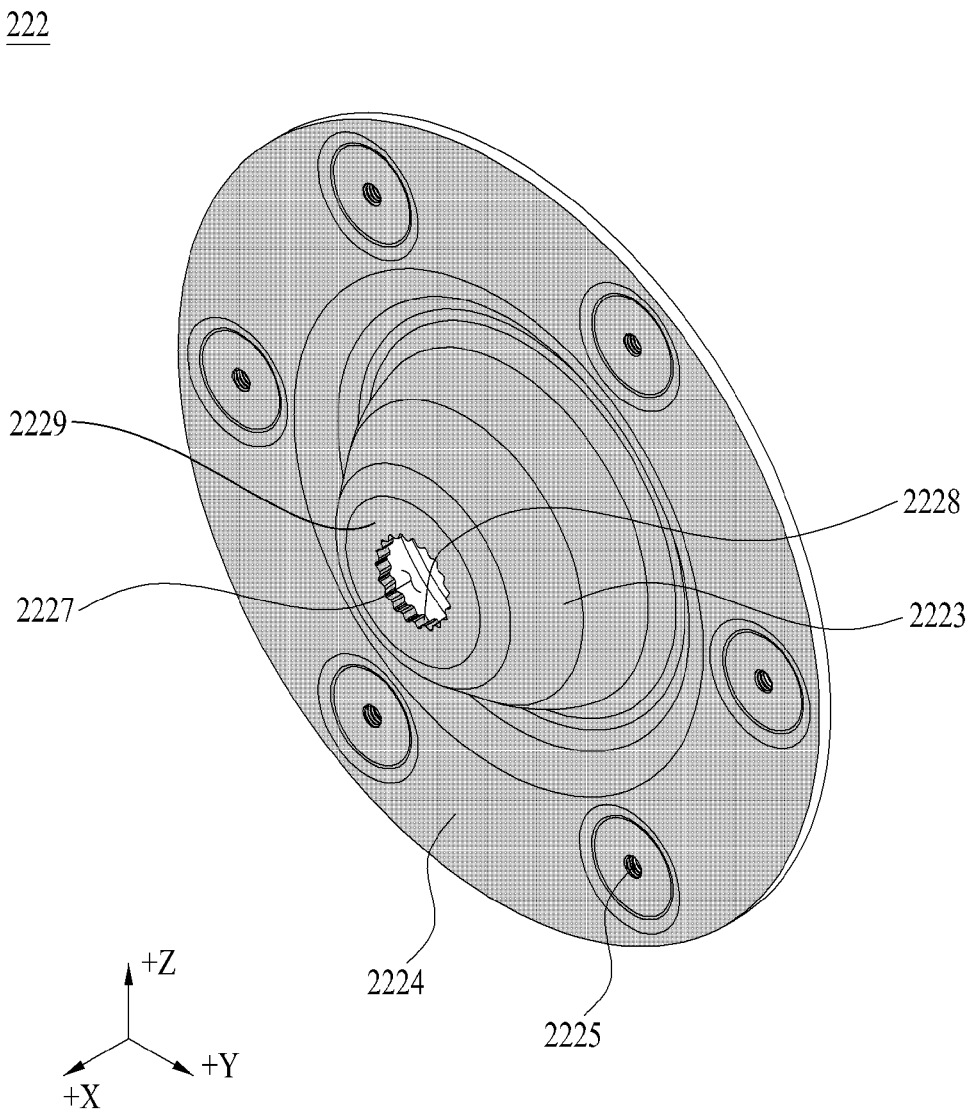

[Fig. 8]
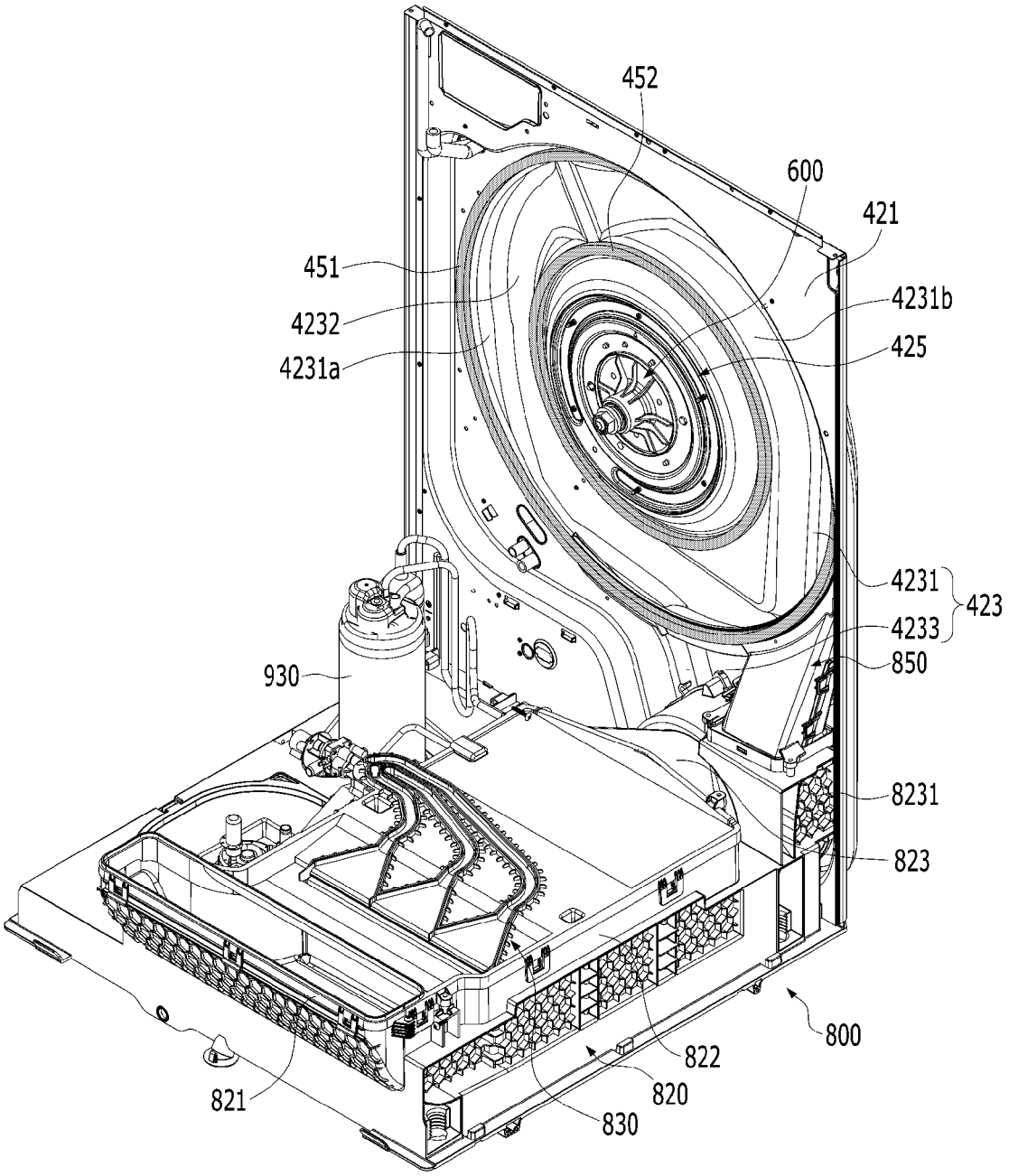

[Fig. 9]
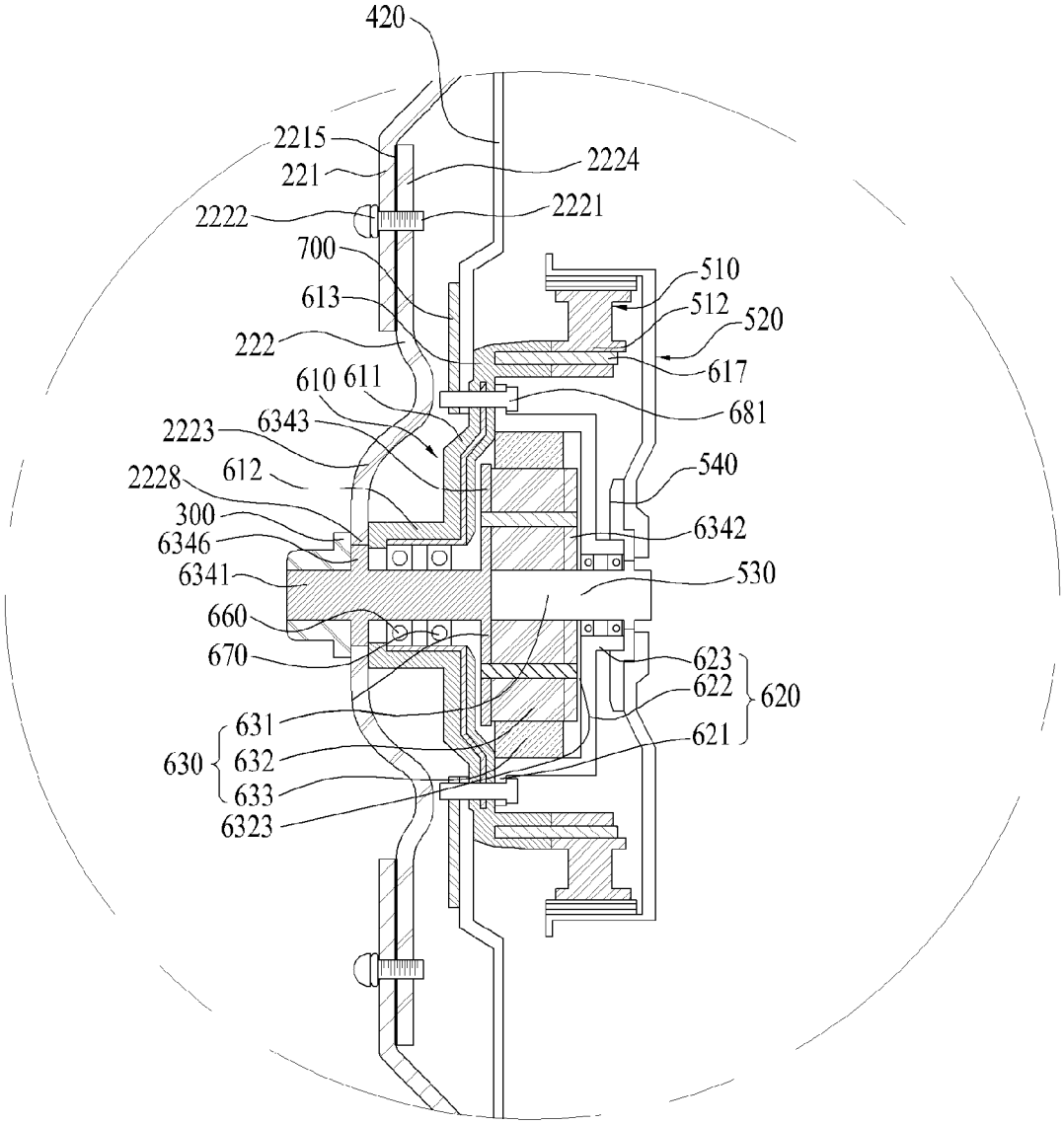

[Fig. 10]
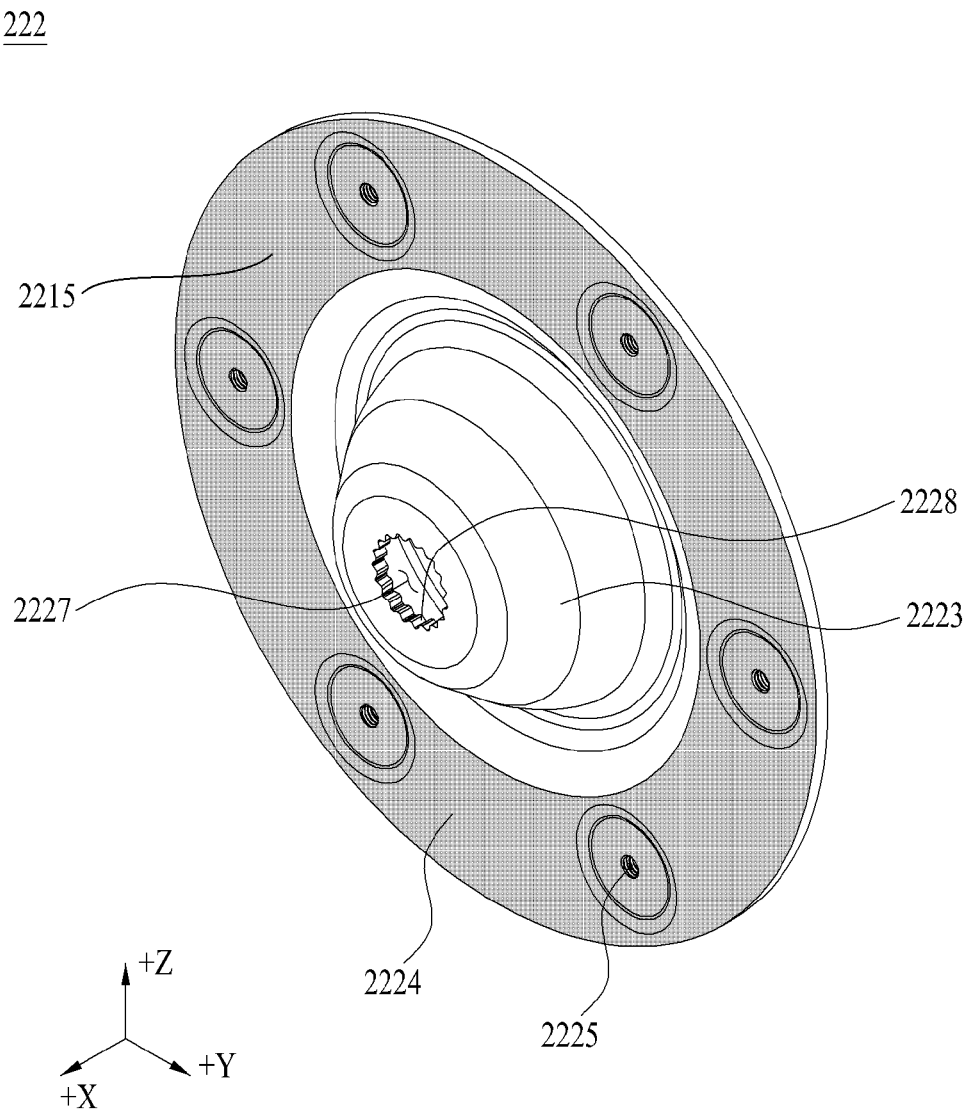

[Fig. 11]
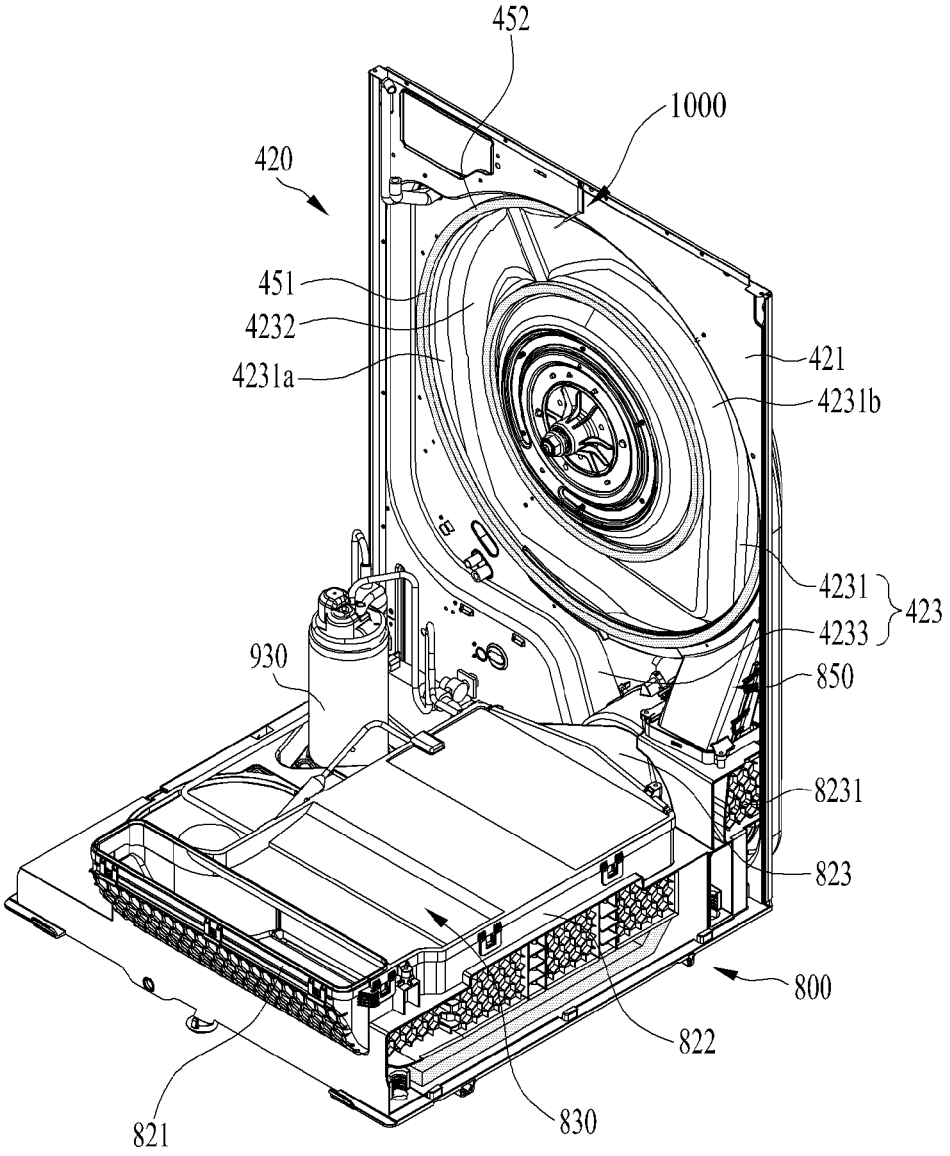

[Fig. 12A]
1000-1(1000)
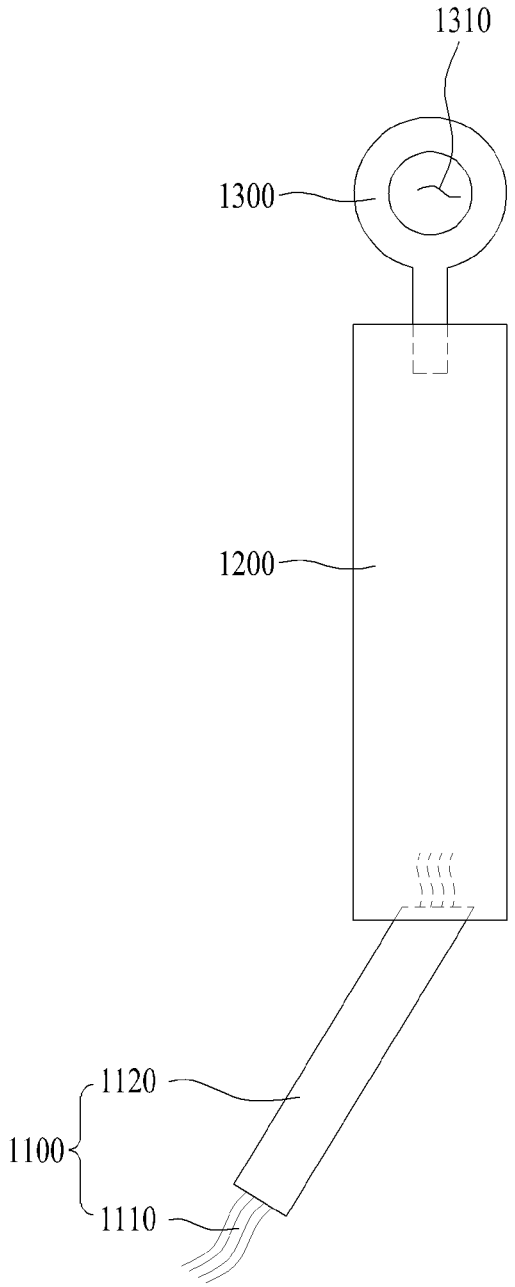

[Fig. 12B]
1000-2(1000)
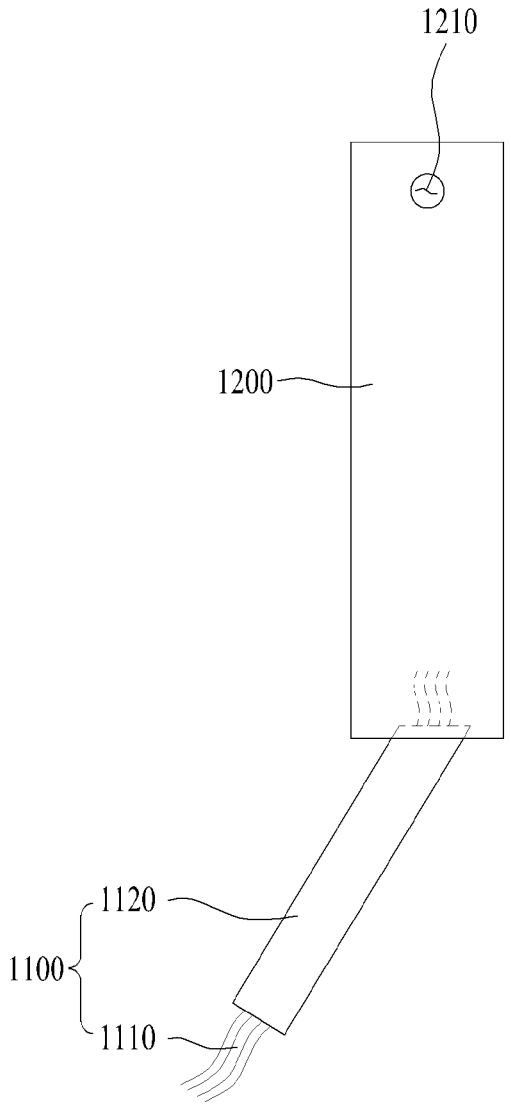

[Fig. 13]
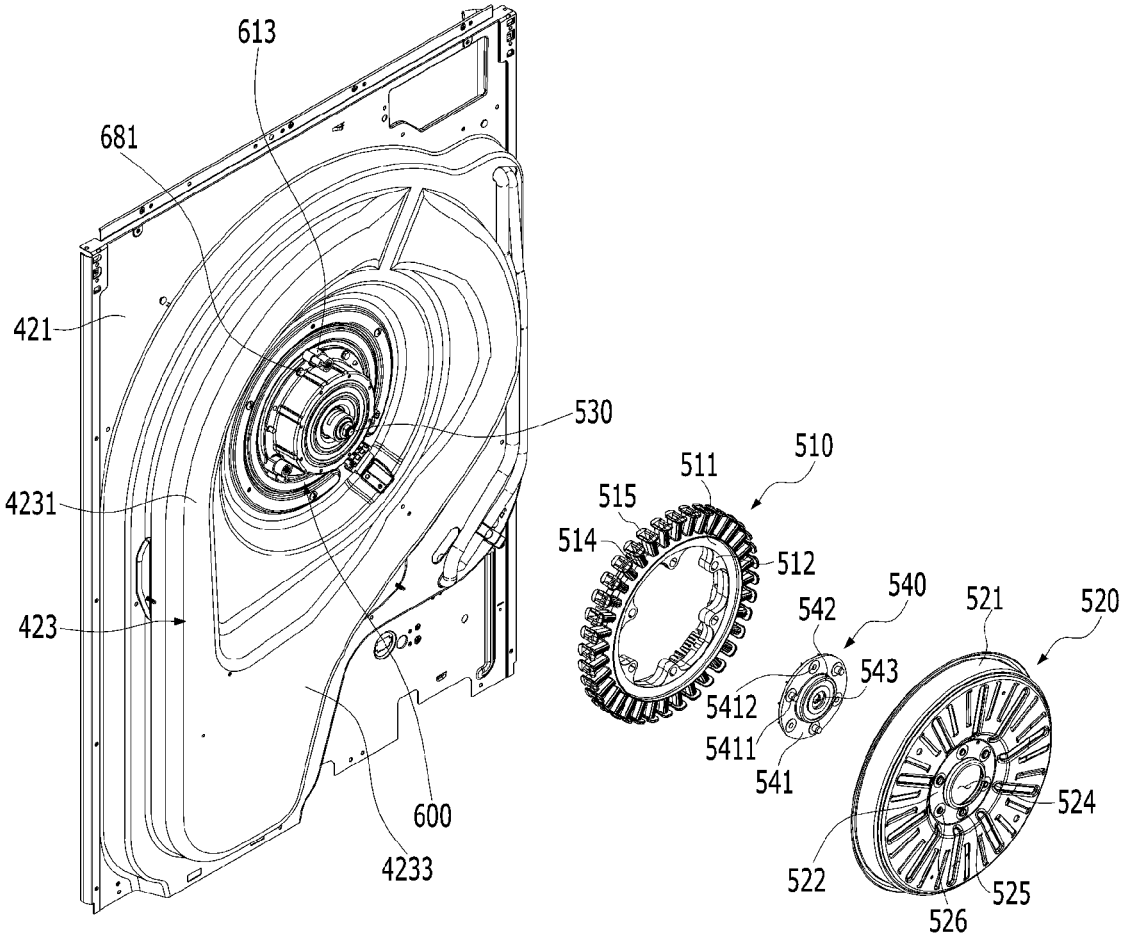

LAUNDRY TREATMENT APPARATUS

CROSS-REFERENCE TO RELATED APPLICATIONS

This application is a National Stage application under 35 U.S.C. § 371 of International Application No. PCT/KR2023/000751, filed on Jan. 16, 2023, which claims the benefit of Korean Application Nos. 10-2022-0006790, filed on Jan. 17, 2022, and 10-2022-0006791, filed on Jan. 17, 2022. The disclosures of the prior applications are incorporated by reference in their entirety.

TECHNICAL FIELD

The present disclosure relates to a laundry treatment apparatus.

BACKGROUND ART

A laundry treatment apparatus includes a washing machine, a drying machine, and the like. The drying machine is an apparatus configured to expose laundry to hot air and remove moisture contained in the laundry. There is also an all-in-one apparatus capable of performing both washing and drying. The drying machine described herein may be a concept including the all-in-one apparatus.

The drying machine may include a drum configured to accommodate laundry, a hot air supply portion configured to supply hot air to the drum, and a driving portion configured to rotate the drum. The drying machine supplies hot air to the inside of the drum to dry the laundry accommodated in the drum, and rotates the drum to evenly expose the surface of the laundry to the hot air. As a result, the entire surface of the laundry is evenly brought into contact with the hot air, and drying may be completed.

FIG. 1 illustrates the structure of a related art drying machine recognized by an applicant and inventors of this application. FIG. 1 illustrates the structure in which a driving portion is coupled to the rear surface of a cabinet.

The drying machine may include a cabinet 1 defining an exterior, a drum 2 rotatably provided in the cabinet 1 and configured to accommodate laundry, and a driving portion 3 configured to rotate the drum 2. The driving portion 3 has a rotating shaft coupled to the drum 2.

The driving portion 3 may be coupled to and fixed to a rear panel 11 defining the rear surface of the cabinet 1. The driving portion 3 may include a stator 31, a rotor 32 rotated by the stator 31, and a rotating shaft 33 coupled to the rotor 32 so as to rotate the drum 2. That is, the driving portion 3 is located at the rear surface of the drum 2. The rotating shaft 33 of the driving portion 3 is coupled to the drum 2. The drum 2 may rotate by rotation of the rotating shaft 33. According to the illustrated structure, the driving portion 3 is fixed to the cabinet 1 so as to rotate the drum 2. Further, the drying machine may further may include a fixing unit 4 configured to fix the driving unit 3 to the rear panel 11. The fixing unit 4 may include at least one of a first fixing member 41 configured to fix the stator 31 to the rear panel 111, and a second fixing member 42 configured to fix the rotating shaft 33 to the rear panel 11.

In the drying machine described with reference to FIG. 1, the drum 2 is rotated by the driving portion 3 directly connected thereto. However, a problem that leakage current generated in the driving portion 3 is transmitted to the drum 2 through the rotating shaft may not be recognized. Leakage current transmitted from the driving portion 3 to the drum 2 is accumulated in the laundry, leading to a problem in that static electricity is felt when a user touches the laundry.

DISCLOSURE OF INVENTION

Technical Problem

One technical task of the present disclosure is to provide a laundry treatment apparatus capable of solving the related art problems.

Another technical task of the present disclosure is to provide a laundry treatment apparatus capable of solving the problem of current accumulation in a drum.

Another technical task of the present disclosure is to provide a laundry treatment apparatus capable of solving the problem that current accumulated in a drum causes discomfort to a user.

Another technical task of the present disclosure is to provide a laundry treatment apparatus in which leakage current from a driving portion and/or a cabinet is prevented from being transmitted to a drum.

Another technical task of the present disclosure is to provide a laundry treatment apparatus in which static electricity generated by rotation of a drum may be transmitted to the outside of the drum.

Another technical task of the present disclosure is to provide a laundry treatment apparatus in which leakage current from a driving portion and/or a cabinet is not introduced into a drum, and static electricity generated by rotation of the drum may be discharged to the outside of the drum.

The tasks to be solved in the present disclosure may not be limited to the aforementioned, and other problems to be solved by the present disclosure will be clearly understood by a person skilled in the art based on the following description.

Solution to Problem

The present disclosure provides a laundry treatment apparatus capable of solving the above mentioned problems.

In one technical aspect of the present disclosure, provided is a laundry treatment apparatus including a cabinet, a drum rotatably provided in the cabinet and configured to accommodate laundry, having a cylindrical shape, having one side open so as to define an input opening, and having another side defining a drum rear plate, and a driving portion having a drum rotating shaft coupled to the drum rear plate so as to provide power to rotate the drum. Here, the laundry treatment apparatus may further include a filter layer provided at a portion where the drum rotating shaft is brought into contact with the drum and made of a material that blocks leakage current.

In one embodiment, the drum rotating shaft may have formed thereon first teeth, the drum rear plate may have formed thereon second teeth meshing with the first teeth, and the filter layer may be provided on at least one of the first teeth and the second teeth.

In one embodiment, the drum rear plate may be fastened to the drum rotating shaft using a fastening member, and the filter layer may be provided on at least a portion where the fastening member is brought into contact with the drum rear plate.

In one embodiment, the drum rear plate may further include a mounting plate coupled to the drum rotating shaft, and the filter layer may be provided on the mounting plate.

In one embodiment, the drum rear plate may further include a circumferential plate coupled to the mounting plate and defining a circumference of the drum rear plate. Here, the filter layer may be provided at least at a portion where the mounting plate and the circumferential plate come into contact with each other.

In one embodiment, the drum rear plate and the drum rotating shaft may be conductors.

In one embodiment, the filter layer may be provided on at least one surface of the drum rear plate facing an inner surface of the drum.

In one embodiment, the filter layer may be provided on at least another surface of the drum rear plate facing the driving portion.

In one embodiment, the driving portion may include a reducer and a motor portion, and the drum rotating shaft may be connected to the reducer.

In one embodiment, the material may have resistance to block leakage current leaked from the driving portion from flowing to the drum, and to discharge static electricity accumulated in the drum due to rotation of the drum.

In one embodiment, the material may have a resistance of $10^6$ ohm or above and $10^9$ ohm or less.

In one embodiment, the material may include a conductive polymer.

In one embodiment, the material may be composed of urethane and a conductive polymer.

In one embodiment, the drum rear plate may include a mounting plate coupled to the drum rotating shaft, a circumferential plate coupled to the mounting plate and defining a circumference of the drum rear plate, and a fastening member configured to connect the mounting plate to the circumferential plate. Here, the fastening member may have an electrical insulator fitted thereto.

In another technical aspect of the present disclosure, provided is a laundry treatment apparatus including a cabinet, a drum rotatably provided in the cabinet and configured to accommodate laundry, having a cylindrical shape, having one side open so as to define an input opening, and having another side defining a drum rear plate, a driving portion having a drum rotating shaft coupled to the drum rear plate so as to provide power to rotate the drum, an electrical insulating layer provided on a portion where the driving portion is connected to the drum, and a grounding member having one end brought into contact with the drum and another end brought into contact with the cabinet, and comprising a filter member having at least a portion forming an electric passage having a resistivity of $10^6$ ohm or greater and $10^9$ ohm or less.

In one embodiment, the filter member may have resistance to block leakage current from the cabinet from flowing to the drum, and to discharge static electricity accumulated in the drum due to rotation of the drum.

In one embodiment, the one end of the grounding member may be implemented as a metal brush extending from the filter member.

In one embodiment, the one end of the grounding member may be implemented as a wire composed of a plurality of strands extending from the filter member.

In one embodiment, the other end of the grounding member may be provided with a washer portion, and the washer portion may be coupled to the cabinet.

In one embodiment, the drum rear plate may include a mounting plate coupled to the drum rotating shaft, and a circumferential plate coupled to the mounting plate and defining a circumference of the drum rear plate. Here, the electrical insulating layer may be provided at least at a portion where the mounting plate and the circumferential plate come into contact with each other.

In one embodiment, the mounting plate and the circumferential plate may be conductors.

In one embodiment, the electrical insulating layer may be formed on the circumferential plate.

In one embodiment, the mounting plate may be fastened to the circumferential plate using a fastening member, and the fastening member may be provided with an electrical insulator.

In one embodiment, the mounting plate may have a circumference having formed thereon a flange portion, the flange portion may be brought into contact with the circumferential plate, and the electrical insulating layer may be provided at a portion where the flange portion is brought into contact with the circumferential plate.

In one embodiment, the cabinet may include a front panel defining a front surface of an exterior of the cabinet, an upper panel defining an upper surface of the exterior of the cabinet, a side panel defining a side surface of the exterior of the cabinet, and a rear plate defining a rear surface of the cabinet. Here, the other end of the grounding member may be brought into contact with the rear plate.

Advantageous Effects of Invention

According to various embodiments of the present disclosure, the related art problem may be solved.

According to various embodiments of the present disclosure, the problem of current accumulation in a drum may be solved.

According to various embodiments of the present disclosure, the problem that current accumulated in a drum causes discomfort to a user may be solved.

According to various embodiments of the present disclosure, leakage current from a driving portion and/or a cabinet may be prevented from being transmitted to a drum.

According to various embodiments of the present disclosure, static electricity generated by rotation of a drum may be transmitted to the outside of the drum.

According to various embodiments of the present disclosure, leakage current from a driving portion and/or a cabinet is not introduced into a drum and static electricity generated by rotation of the drum is discharged to the outside of the drum, thereby preventing accumulation of static electricity in the drum.

The effect of the present disclosure is not limited to the above-mentioned effects, and effects not mentioned herein will be clearly understood by those skilled in the art from the present specification and the accompanying drawings.

BRIEF DESCRIPTION OF DRAWINGS

FIG. 2 illustrates the exterior of a laundry treatment apparatus according to an embodiment of the present disclosure;

FIG. 3 illustrates the interior of a laundry treatment apparatus according to an embodiment of the present disclosure;

FIG. 4 is an exploded perspective view of a laundry treatment apparatus according to an embodiment of the present disclosure;

FIGS. 5A and 5B illustrate a reducer of a laundry treatment apparatus according to an embodiment of the present disclosure;

FIG. 6 is an enlarged view of the inside of the dotted line in FIG. 3, and is a structure according to a first embodiment;

FIGS. 7A-7C are perspective views of a mounting plate according to an embodiment of the present disclosure;

FIG. 8 is a front perspective view of a structure in which a rear plate and a base of a laundry treatment apparatus according to an embodiment of the present disclosure are coupled to each other;

FIG. 9 is an enlarged view of the inside of the dotted line in FIG. 3, and is a structure according to a second embodiment;

FIG. 10 is a perspective view of a mounting plate according to an embodiment of the present disclosure;

FIG. 11 is a front perspective view of a structure in which a rear plate and a base of a laundry treatment apparatus according to a second embodiment of the present disclosure are coupled to each other;

FIG. 12A illustrates a grounding member according to a first embodiment of the present disclosure;

FIG. 12B illustrates a grounding member according to a second embodiment of the present disclosure; and FIG. 13 is an exploded view illustrating that a reducer and a motor portion are coupled to the rear of a rear plate of a laundry treatment apparatus according to an embodiment of the present disclosure.

MODE FOR THE INVENTION

Figure 1:
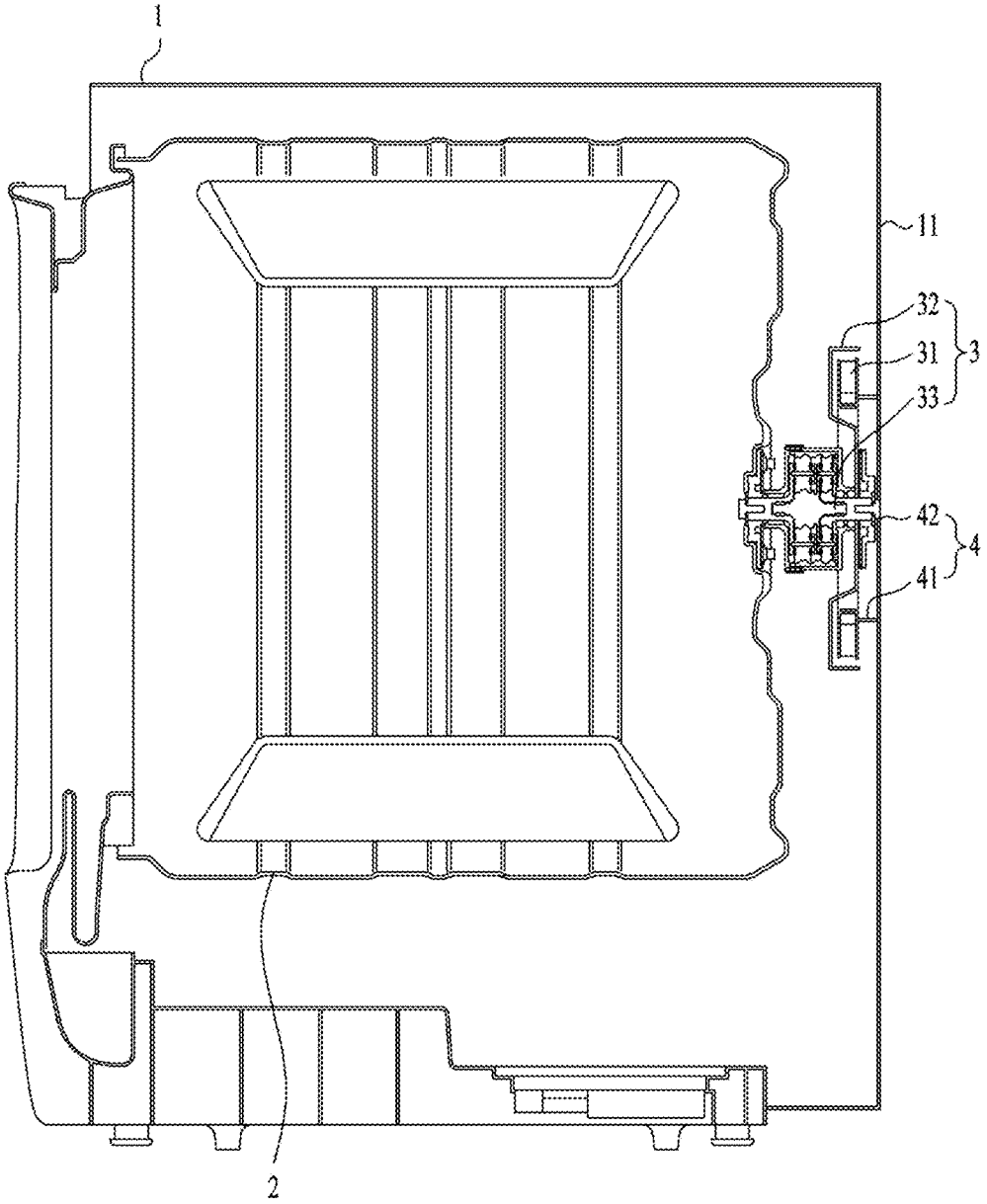
FIG. 1 illustrates the structure of an embodiment of a related art drying machine.

Hereinafter, with reference to the accompanying drawings, embodiments of the present disclosure will be described in detail so that those skilled in the art can easily implement the present disclosure.

However, the present disclosure may be implemented in several different forms and is not limited to the embodiments described herein. In order to clearly illustrate the present disclosure, components not related to the description are omitted, and similar components are denoted by like reference numerals throughout the specification.

In this specification, redundant descriptions of the same components are omitted.

It will be understood that when an element is referred to as being "connected to" another element, the element can be connected to the other element or intervening elements may also be present. In contrast, when an element is referred to as being "directly connected to" another element, there are no intervening elements present.

The terminology used herein is for the purpose of describing particular embodiments only, and is not intended to be limiting.

In addition, a singular representation may include a plural representation unless it represents a definitely different meaning from the context.

It will be further understood that the terms "comprise", "have", etc., when used in this specification, specify the presence of stated features, integers, steps, operations, elements, components, or combinations thereof, but do not preclude the presence or addition of one or more other features, integers, steps, operations, elements, components, or combinations thereof.

The term "and/or" includes a combination of a plurality of related listed items or any of the plurality of related listed items. In this specification, "A or B" may include "A", "B", or "both A and B."

FIG. 2 illustrates the exterior of a laundry treatment apparatus according to the present disclosure. Hereinafter, the same will be described with reference to FIG. 2.

The laundry treatment apparatus according to an embodiment of the present disclosure may include a cabinet 100. The cabinet 100 defines the exterior of the laundry treatment apparatus.

The cabinet 100 may include a front panel 110 defining the front surface of the laundry treatment apparatus, an upper panel 150 defining the upper surface of the laundry treatment apparatus, and a side panel 140 defining the side surface of the laundry treatment apparatus. The side panel 140 may include a left side panel 141 defining the left side surface. The front panel 110 may have formed therein an opening 111 configured to communicate with the inner portion of the cabinet 100, and may be provided with a door 130 rotatably coupled to the cabinet 100 and configured to open and close the opening 111.

The front panel 110 may have an operation panel 117 mounted thereon. The operation panel 117 may be provided with an input portion 118 configured to receive a control command from a user, and an output portion 119 on which information such as a control command selectable by a user is output. The control command may include a drying course or a drying option capable of performing a series of drying operations. The cabinet 100 may have an inner portion having mounted therein a control box, configured to control the internal components so as to carry out the control command input through the input portion 118. The control box may be connected to the components inside the laundry treatment apparatus and may control components corresponding thereto to execute the control command.

The input portion 118 may include a power supply request portion configured to request power supply to the laundry treatment apparatus, a course input portion configured to allow a user to select a desired course among multiple courses, and an execution request portion configured to request start of the course selected by the user.

The output portion 119 may include at least one of a display panel capable of outputting text and figures, and a speaker capable of outputting voice signals and sounds.

Meanwhile, the laundry treatment apparatus of the present disclosure may include a water storage tank 120 configured to separately store moisture generated in the process of drying laundry. The water storage tank 120 may include a handle provided to be drawn out from one side of the front panel 110. The water storage tank 120 may collect condensed water generated during the drying operation. Accordingly, a user may withdraw the water storage tank 120 from the cabinet 100 to remove the condensed water, and then mount the water storage tank 120 back into the cabinet 100. For this reason, the laundry treatment apparatus according to an embodiment may be disposed even in a place where a sewer or the like is not installed.

FIG. 3 is a view schematically illustrating the interior of the laundry treatment apparatus according to an embodiment of the present disclosure. Hereinafter, the same will be described with reference to FIG. 3.

The laundry treatment apparatus may include a drum 200, a driving portion, a heat exchanging portion 900, and a base 800.

The drum 200 is accommodated inside the cabinet 100 and configured to accommodate laundry. The driving portion rotates the drum 200. The heat exchanging portion 900 may supply hot air to the drum 200. The base 800 may be provided with a circulation flow portion 820.

The circulation flow portion 820 communicates with the drum 200. Air discharged from the drum 200 may be supplied to the circulation flow portion 820. In addition, the air discharged from the circulation flow portion 820 may be supplied back to the drum 200.

The driving portion may include a motor portion 500 configured to provide power to rotate the drum 200. The driving portion may be directly connected to the drum 200 so as to rotate the drum 200. For example, the driving portion may be a direct drive (DD) unit type. The driving portion may directly rotate the drum 200 so as to control the rotation direction or the rotation speed of the drum 200. Existing components such as a belt and a pulley in the driving portion may be removed.

The drum 200 may be rotated at a high RPM. For example, the drum 200 may be rotated at a much greater RPM than the RPM at which the drum 200 may rotate while laundry inside the drum 200 is attached to the inner wall of the drum 200. However, when the drum 200 is continuously rotated in the state in which the laundry in the drum 200 is attached to the inner wall of the drum 200, the portion of the laundry attached to the inner wall of the drum is not exposed to hot air, thereby decreasing drying efficiency. When the drum 200 is rotated at a low RPM so that the laundry in the drum 200 is rolled or stirred without being attached to the inner wall of the drum 200, the output or torque that may be generated by the driving portion is not properly utilized. The driving portion of the laundry treatment apparatus according to an embodiment of the present disclosure may further include a reducer 600 capable of increasing torque while utilizing the maximum output of the motor portion 500 by reducing the RPM.

The driving portion may include a drum rotating shaft 6341 connected to the drum 200 and configured to rotate the drum 200.

The drum 200 may have a cylindrical shape. Laundry may be accommodated in the inner space of the drum 200. The illustrated embodiment is a drying machine. Therefore, unlike the drum used for washing, water does not need to be injected into the drum 200 used only for drying. In the drum 200 of the illustrated embodiment, through holes provided along the circumferential surface of the drum 200 may be omitted.

The drum 200 may be manufactured to have an integral cylindrical shape. The drum 200 may be manufactured to have a structure in which a drum body 210 including a circumferential surface is coupled to a drum rear plate 220 defining a rear surface.

The drum body 210 may have a front having formed therein an input opening 211 through which laundry enters and exits. The drum rear plate 220 may have a rear to which the driving portion configured to rotate the drum 200 is connected. The drum body 210 and the drum rear plate 220 may be coupled to each other by a fastening member such as a bolt, without being limited thereto. The drum body 210 and the drum rear plate 220 may be coupled to each other using various methods as long as the same are coupled to rotate together.

The drum body 210 may have a circumferential surface provided with a reinforcing bead 212.

The drum body 210 may be provided with a lift 213. The lift 213 lifts the laundry in the drum 200 to the upper portion so that the laundry is mixed while the drum 200 rotates.

Generally, in the case of a DD-type washing machine, the driving portion is coupled to be fixed to a tub configured to accommodate the drum 200, and the drum 200 may be coupled to the driving portion and supported by the tub. However, because the laundry treatment apparatus according to this embodiment is provided to be focused on the drying operation, the tub fixed to the cabinet 100 and accommodating the drum 200 is omitted.

The laundry treatment apparatus according to an embodiment may further include a support portion configured to fix or support the drum 200 or the driving portion inside the cabinet 100. The support portion may include a front plate 410 disposed at the front of the drum 200, and a rear plate 420 disposed at the rear of the drum 200.

The front plate 410 and the rear plate 420 may have a plate shape and may be disposed to face the front and the rear of the drum 200, respectively. The distance between the front plate 410 and the rear plate 420 may be equal to or greater than the length of the drum 200. The front plate 410 and the rear plate 420 may be supported by being fixed to the bottom surface of the cabinet 100 or to the base 800.

The front plate 410 may be disposed between the front panel 110, defining the front surface of the cabinet 100, and the drum 200. The front plate 410 may have formed therein an input communication hole 412 configured to communicate with the input opening 211. The drum 200 may have a front surface supported by the front plate 410. Laundry may be put into the drum 200 or taken out of the drum 200 through the input communication hole 412.

The front plate 410 may include a duct connection portion 416. The duct connection portion 416 may be provided at the lower side of the input communication hole 412. The duct connection portion 416 may define the lower surface of the front plate 410. The duct connection portion 416 forms a flow passage configured to communicate the inner portion of the drum 200 with the circulation flow portion 820.

The front plate 410 may include a duct communication hole 417 penetrating the duct connection portion 416. The duct connection portion 416 may communicate with the inner portion of the drum 200 through the duct communication hole 417. The duct communication hole 417 may have a hollow shape and may guide air discharged through the input opening 211 in the drum 200 to the lower side of the drum 200. The duct communication hole 417 may guide the air discharged through the input opening 211 to the circulation flow portion 820 located at the lower portion of the drum 200. The air discharged from the drum 200 may be introduced into the duct connection portion 416 through the duct communication hole 417 and be guided to the circulation flow portion 820.

The duct connection portion 416 may have installed therein a filter (not shown) configured to filter foreign substances or lint (generated from laundry) from the air discharged from the drum 200 and prevent foreign substances from entering the circulation flow portion 820. In an embodiment, the filter (not shown) may be installed over the periphery of the duct communication hole 417. The filter (not shown) may filter the air discharged from the drum 200 so as to prevent foreign substances from accumulating inside the laundry treatment apparatus. The filter (not shown) may prevent foreign substances from accumulating in the flow passage and interfering with the circulation of air.

The driving portion may be installed on the rear plate 420 rather than on the front plate 410. The driving portion may be mounted on and supported by the rear plate 420. The driving portion may rotate the drum 200 in a state in which the position of the driving portion is stably fixed by the rear plate 420.

At least one of the front plate 410 and the rear plate 420 may support the drum 200. The drum 200 may be supported by at least one of the front plate 410 and the rear plate 420 and may be rotatably supported. At least one of the front plate 410 and the rear plate 420 may rotatably accommodate the front end or the rear end of the drum 200.

For example, the front of the drum 200 may be rotatably supported by the front plate 410. The rear of the drum 200 may be spaced apart from the rear plate 420 but indirectly supported by the rear plate 420 by being connected to the motor portion 500 mounted on the rear plate 420. According to an embodiment of the present disclosure, an area where the drum 200 is brought into contact with or rubs against a support portion may be minimized, and unwanted noise or vibration may be prevented from being generated. Of course, the drum 200 may be rotatably supported by both the front plate 410 and the rear plate 420.

The front plate 410 may have a lower portion provided with one or more support wheels 415 configured to support the front of the drum 200. The support wheel 415 may be provided on the rear surface of the front plate 410. The support wheel 415 is rotatable. The support wheel 415 may rotate while being in contact with the lower portion of the drum 200.

When the drum 200 is rotated by the driving portion, the drum 200 may be supported by the drum rotating shaft 6341 connected to the rear of the drum 200. When laundry is accommodated in the drum 200, a load applied to the drum rotating shaft 6341 by the laundry may increase. Therefore, there is a risk of the drum rotating shaft 6341 being bent by the load. When the support wheel 415 supports the drum 200, the load applied to the drum rotating shaft 6341 may be reduced.

The support wheel 415 may be provided in plural. The plurality of support wheels 415 may be provided at symmetrical positions with respect to the center of rotation of the drum 200 so as to support the load of the drum 200.

The circulation flow portion 820 provided in the base 800 may form a flow passage through which air inside the drum 200 is circulated and introduced back into the drum 200. The circulation flow portion 820 may include an inlet duct 821 through which air discharged from the drum 200 is introduced, a discharge duct 823 configured to supply air to the drum 200, and a moving duct 822 configured to interconnect the inlet duct 821 and the discharge duct 823.

When air is discharged from the front of the drum 200, the moving duct 822 may be located at the front side of the circulation flow portion 820. In addition, the discharge duct 823 may be located at the rear side of the circulation flow portion 820.

The discharge duct 823 may further include a blower 8231 configured to discharge air out of the circulation flow portion 820. The blower 8231 may be provided at the rear side of the discharge duct 823. The blower 8231 may provide a space in which a circulation flow fan 950 is installed. Air discharged through the blower 8231 may move to the drum 200.

The circulation flow portion 820 may have an upper side to which a duct cover portion 830 is coupled. The duct cover portion 830 may define one surface of a flow passage through which air circulates. The duct cover portion 830 may partially shield an open upper surface of the circulation flow portion 820. The duct cover portion 830 may prevent air from leaking out of the circulation flow portion 820.

The heat exchanging portion 900 may be provided in the circulation flow portion 820. The heat exchanging portion 900 may include a first heat exchanger 910 configured to cool air, and a second heat exchanger 920 configured to heat the air cooled by the first heat exchanger 910.

The first heat exchanger 910 may dehumidify the air discharged from the drum 200. The second heat exchanger 920 may heat the dehumidified air. The heated air may be supplied back to the drum 200 so as to dry laundry accommodated in the drum 200.

The first heat exchanger 910 and the second heat exchanger 920 may be provided as heat exchangers through which refrigerant flows. When provided as a heat exchanger through which refrigerant flows, the first heat exchanger 910 may be an evaporator, and the second heat exchanger 920 may be a condenser. The refrigerant moving through the first heat exchanger 910 and the second heat exchanger 920 may exchange heat with the air discharged from the drum 200.

The circulation flow fan 950 may be installed in the circulation flow portion 820. The circulation flow fan 950 may be installed in any one of the inlet duct 821, the moving duct 822, and the discharge duct 823. The circulation flow fan 950 generates air flow inside the circulation flow portion 820. The circulation flow fan 950 may be rotated by a circulation flow fan motor 951. The circulation flow fan 950 may rotate by receiving rotational power from the circulation flow fan motor 951. The air circulating in the circulation flow portion 820 may be moved by the circulation flow fan 950 and dehumidified in the first heat exchanger 910, and the air heated in the second heat exchanger 920 may move to the rear of the drum 200.

The circulation flow fan 950 may be installed in the blower 8231. In addition, the circulation flow fan motor 951 may be located at the rear of the blower 8231. When the circulation flow fan 950 is rotated by the circulation flow fan motor 951, the air inside the circulation flow portion 820 may be discharged to the outside of the circulation flow portion 820 through the blower 8231.

The drum 200 may have the rear provided with the rear plate 420 configured to guide the air discharged from the circulation flow portion 820 to the drum 200. The rear plate 420 may be spaced apart from the drum rear plate 220. The circulation flow portion 820 may receive air inside the drum 200 through the front plate 410. Air from the circulation flow portion 820 may be supplied to the drum 200 through the rear plate 420. Air discharged from the circulation flow portion 820 may pass through the rear plate 420 and be guided to the drum 200.

The base 800 may further include a connector 850. The connector 850 guides the air discharged from the circulation flow portion 820 to the rear plate 420. The connector 850 may guide the discharged air to be evenly distributed throughout the rear plate 420. The connector 850 may be installed in the blower 8231. The connector 850 may guide the air discharged from the blower 8231 to the rear plate 420. Hot air supplied to the rear plate 420 may be introduced into the drum 200 through the drum rear plate 220.

The drum 200 of the laundry treatment apparatus according to an embodiment of the present disclosure is not rotated indirectly by being coupled to a belt or the like, but may be directly connected to and rotated by the driving portion located at the rear of the drum 200. The drum 200 of the laundry treatment apparatus according to an embodiment of the present disclosure may have the rear shielded and directly coupled to the driving portion.

As described above, the drum body 210 has a cylindrical shape and accommodates laundry. The drum rear plate 220 is coupled to the rear of the drum body 210 so as to define the rear surface of the drum. The drum rear plate 220 may provide a coupling surface directly coupled to the driving portion. The drum rear plate 220 may be connected to the driving portion to receive rotational power to thereby rotate the entire drum 200.

A driving shaft coupling portion 300 interconnects the driving portion and the drum rear plate 220. The driving shaft coupling portion 300 may be a center of rotation of the drum 200. The driving shaft coupling portion 300 may be integrated with the drum rear plate 220, but may also be made of a material having greater rigidity or durability than the drum rear plate 220 in order to be firmly coupled to the drum rotating shaft 6341 configured to transmit power. The driving shaft coupling portion 300 may be located at a position coaxial with the rotation center of the drum rear plate 220. The driving shaft coupling portion 300 may be directly or indirectly brought into contact with the drum rear plate 220. The driving shaft coupling portion 300 may be a bushing or nut coupled to the drum rotating shaft 6341.

The drum rear plate 220 may include a circumferential plate 221 and a mounting plate 222. The circumferential plate 221 may be coupled to the outer circumferential surface of the drum body 210. The mounting plate 222 may be provided on the inner side of the circumferential plate 221 and coupled to the driving portion. The driving shaft coupling portion 300 may be seated on and coupled to the mounting plate 222. Because the drum rotating shaft 6341 configured to rotate the drum 200 is coupled to the mounting plate 222 through the driving shaft coupling portion 300, the drum rotating shaft 6341 may be more firmly coupled to the mounting plate 222. In addition, the mounting plate 222 may prevent deformation of the drum rear plate 220.

A cover member 229 may cover a portion where the mounting plate 222 is coupled to the driving portion and a portion where the mounting plate 222 is coupled to the circumferential plate 221. In other words, the circumferential plate 221 is exposed inside the drum 200, but the portion where the mounting plate 222 is coupled to the driving portion and the portion where the mounting plate 222 is coupled to the circumferential plate 221 are covered by the cover member 229 and are not exposed to the outside.

The drum rear plate 220 has formed therein a suction hole 224. The suction hole 224 may be formed in the circumferential plate 221. The front of the drum rear plate 220 and the rear of the drum rear plate 220 communicate with each other through the suction hole 224. Air may be introduced into the drum 200 from the rear of the drum 200 through the suction hole 224. Hot air supplied through the circulation flow portion 820 may be introduced into the drum 200 through the suction hole 224. The suction hole 224 may be a plurality of holes penetrating the drum rear plate 220 or may be implemented as a mesh-type net.

The driving portion configured to rotate the drum 200 may be located at the rear of the rear plate 420. The driving portion may include the motor portion 500 and the reducer 600. The motor portion 500 generates rotational power. The reducer 600 reduces the rotational power of the motor portion 500 and transmits the same to the drum 200. The motor portion 500 may be coupled to the rear plate 420 through the reducer 600. The reducer 600 may be fixed to the rear surface of the rear plate 420, and the motor portion 500 may be coupled to the rear surface of the reducer 600. The rear plate 420 may provide a support surface by which the reducer 600 or the motor portion 500 is supported. However, the motor portion 500 may also be coupled to the rear plate 420.

FIG. 4 is an exploded perspective view illustrating that the internal components constituting the laundry treatment apparatus according to an embodiment of the present disclosure are separated from one another.

The laundry treatment apparatus according to an embodiment of the present disclosure may include the drum 200, the front plate 410, the rear plate 420, the base 800, the motor portion 500, the reducer 600, and a rear cover 430. The rear cover 430 is coupled to the rear plate 420 so as to prevent the motor portions from being exposed to the outside.

The front plate 410 includes the front panel 411 defining the front surface. The front panel 411 may have formed therein the above-described input communication hole 412.

The front panel 411 may have a rear surface provided with a front gasket 413. The front gasket 413 may surround the radially outer side of the input communication hole 412. The front gasket 413 may accommodate a portion of the drum body 210. The front gasket 413 may rotatably support the drum body 210. The front gasket 413 may be brought into contact with the outer circumferential surface or the inner circumferential surface of the input opening 211. The front gasket 413 may prevent hot air inside the drum 200 from leaking between the drum body 210 and the front plate 410. The front gasket 413 may be made of a plastic resin or an elastic material. A separate sealing member is additionally coupled to the front gasket 413 so as to prevent laundry or hot air from escaping from the drum body 210 to the front plate 410.

The front plate 410 may have formed therein a water storage tank support hole 414 through which the water storage tank 120 (see FIG. 2) may be drawn out or supported.

The drum rear plate 220 may include reinforcing ribs 225. The reinforcing ribs 225 may be provided on the circumferential plate 221. The reinforcing ribs 225 may extend radially from the center of the circumferential plate 221. The reinforcing ribs 225 may extend, while circumventing the suction hole 224. The reinforcing ribs 225 may prevent the rigidity of the drum rear plate 220 from being reduced due to the suction hole 224.

The drum rear plate 220 may further include a circumferential rib 227. The circumferential rib 227 interconnects the reinforcing ribs 225 to one another. The circumferential rib 227 may have a shape extending along the circumference of the drum rear plate 220. The reinforcing ribs 225 and the circumferential rib 227 may prevent the drum rear plate 220 from being deformed even when rotational force is transmitted from the motor portion 500.

The inlet duct 821 may communicate with the duct communication hole 417 in the front plate 410. The inlet duct 821 may communicate with the flow passage inside the front plate 410 through the duct communication hole 417. The moving duct 822 may extend towards the rear of the drum 200 from an end of the inlet duct 821. The discharge duct 823 may be provided at an end of the moving duct 822 so as to guide air to the drum 200.

The base 800 may have mounted thereon the heat exchanging portion 900 configured to cool and heat air circulating inside the drum 200. The heat exchanging portion 900 may include a compressor 930 connected to the first heat exchanger 910 (see FIG. 3) and to the second heat exchanger 920 (see FIG. 3) so as to supply compressed refrigerant. Because the compressor 930 may be provided so as not to directly exchange heat with the circulating air, the compressor 930 may be located outside the circulation flow portion 820.

The laundry treatment apparatus according to an embodiment of the present disclosure may further include the connector 850. The connector 850 may be coupled to the circulation flow portion 820. The connector 850 guides the hot air discharged from the circulation flow portion 820 to the rear of the drum 200 or to the rear plate 420. The connector 850 may be disposed above the discharge duct 823. The connector 850 may guide the hot air heated through the second heat exchanger 920 to flow above the discharge duct 823. The connector 850 may be coupled to the opening formed in the upper side of the blower 8231. The connector 850 may form a flow passage therein. The connector 850 may guide the flow direction of the air so that the air is evenly distributed to the rear plate 420. The flow passage in the connector 850 may have an area increasing as the distance from the blower 8231 increases.

The rear plate 420 may be coupled to the base 800 or supported by the base 800. The rear plate 420 may include a rear panel 421 and a duct portion 423. The rear panel 421 is disposed to face the front plate 410. The duct portion 423 is recessed in the rear panel 421. The duct portion 423 forms a passage through which air flows and guides the air discharged from the circulation flow portion 820 to the drum 200.

The rear plate 420 may include a mounting portion 425 to which the driving portion is coupled or by which the driving portion is supported. The mounting portion 425 may pass through the rear panel 421. The mounting portion 425 may be disposed on the inner circumferential surface of the duct portion 423. The mounting portion 425 may be spaced apart from the inner circumferential surface of the duct portion 423 in a radially inward direction.

As described above, the driving portion may be an assembly of the reducer 600 and the motor portion 500. Meanwhile, the driving portion may also be the motor portion 500 only. In other words, a structure that generates power and transmits rotational power to the drum may be referred to as the driving portion.

The driving portion may be mounted on the mounting portion 425. The mounting portion 425 may support the load of the driving portion. The driving portion may be connected to the drum 200 while being supported by the mounting portion 425.

The duct portion 423 may accommodate a portion of the drum rear plate 220. The duct portion 423 and the drum rear plate 220 may form a flow passage through which air moves.

The driving portion may be installed on the mounting portion 425 so as to prevent interference with the duct portion 423. In other words, the driving portion may be spaced apart from the inner circumferential surface of the duct portion 423 in a radially inward direction. The driving portion is installed on the mounting portion 425 with the rear side of the driving portion being exposed to the outside so as to be cooled by external air.

The driving portion may include the motor portion 500 configured to provide power to rotate the drum 200. The motor portion 500 may include a stator 510 configured to generate a rotating magnetic field, and a rotor 520 configured to rotate by the stator 510. The rotor 520 may be an outer rotor type configured to accommodate the stator 510 and revolve around the circumference of the stator 510. The rotor 520 has a driving shaft coupled thereto and passing through the stator 510 and the mounting portion 425 so as to be directly connected to the drum 200. Here, the rotor 520 may directly transmit power to rotate the drum 200.

The rotor 520 may be coupled to a driving shaft 530 through a washer portion 540. The washer portion 540 may interconnect the driving shaft 530 and the rotor 520. Because the contact area between the rotor 520 and the driving shaft 530 may be increased by the washer portion 540, rotation of the rotor 520 may be transmitted more effectively.

The reducer 600 may interconnect the motor portion 500 and the drum 200. The reducer 600 may rotate the drum 200 by converting power of the motor portion 500. The reducer 600 may be disposed between the motor portion 500 and the drum 200 so as to receive power from the motor portion 500, convert the power, and transmit the power to the drum 200. The reducer 600 may reduce the RPM of the rotor, but increase the torque value and transmit the same to the drum 200.

Specifically, the reducer 600 may be coupled to the driving shaft 530 that is coupled to the rotor 520 and rotates together with the rotor 520. The reducer 600 may include therein a gear assembly configured to rotate by being engaged with the driving shaft 530 so as to reduce the RPM of the driving shaft 530 but to increase torque. The gear assembly may be coupled to the drum 200 and connected to the drum rotating shaft 6341 configured to rotate the drum 200. Accordingly, when the driving shaft 530 rotates, the drum rotating shaft 6341 rotates at a lower RPM than the driving shaft 530 but may rotate with a greater torque.

The rear plate 420 of the cabinet 100 may be provided as a relatively thin plate. The rear plate 420 may be provided as a steel plate. The rear plate 420 may be made of a metal material.

The laundry treatment apparatus according to an embodiment of the present disclosure may couple and fix the motor portion 500 to the reducer 600. Thus, the reducer 600 may serve as a reference point for the entire driving portion. The reducer 600 may serve as a reference for the amount of vibration and tilt angle of the entire driving portion. In a case where vibration or external force is transmitted to the driving portion, when the reducer 600 tilts or vibrates, the motor portion 500 may always tilt or vibrate simultaneously with the reducer 600. As a result, the reducer 600 and the motor portion 500 may form one vibration system, and may remain fixed without moving relative to each other.

The stator 510 in the motor portion 500 may be directly coupled to and fixed to the reducer 600. As a result, the position where the driving shaft 530 is installed may not vary relative to the reducer 600. The center of the driving shaft 530 and the center of the reducer 600 may be arranged to coincide with each other, and the driving shaft 530 may rotate while maintaining the same axis as the center of the reducer 600. Because the driving shaft 530 rotates with respect to the reducer 600 but is fixed so as not to be tilted and the stator 510 is also fixed to the reducer 600, the distance between the stator 510 and the rotor 520 may always remain constant. As a result, collision between the stator 510 and the rotor 520 may be prevented, and noise or vibration that may occur due to the rotation center being changed while the rotor 520 revolves around the stator 510 may be fundamentally blocked.

The drum rotating shaft 6341 extends from inside the reducer 600 towards the drum 200. The drum rotating shaft 6341 may vibrate and tilt together with the reducer 600. The drum rotating shaft 6341 serves only to rotate in the reducer 600, and the installed position thereof may be fixed. As a result, the drum rotating shaft 6341 and the driving shaft 530 may always be arranged side by side and form a coaxial shaft. The center of the drum rotating shaft 6341 and the center of the driving shaft 530 may be maintained to coincide with each other.

The reducer 600 may be coupled to and fixed to the rear plate 420. Here, the reducer 600 tilts or vibrates while being coupled to the rear plate 420, and thus the rear plate 420 may serve as the center of the vibration system including the reducer 600, the motor portion 500, and the drum 200.

Meanwhile, the coaxiality and coincidence as used herein do not mean physically perfect coaxiality and coincidence, but the same is a concept that allows a range of errors that may be recognized mechanically or a level that may be recognized as coaxiality and coincidence by those skilled in the art. For example, a range in which the driving shaft 530 and the drum rotating shaft 6341 deviate within 5 degrees may be defined as being coaxial or coincident. However, such an angular value is merely an example, and an allowable error in design may be changed.

The drum rear plate 220 and the rear plate 420 may have a sealing portion 450 provided therebetween. The sealing portion 450 may seal between the drum rear plate 220 and the rear plate 420. Due to the sealing portion 450, air introduced into the duct portion 423 of the rear plate 420 may be introduced into the suction hole 224 instead of being discharged to the outside.

The sealing portion 450 may be disposed on the outer surface and the inner surface of the duct portion 423, respectively. The duct portion 423 may have a radially outer side provided with a first seal 451. The duct portion 423 may have a radially inner side provided with a second seal 452. The first seal 451 may prevent hot air from leaking radially outwards from a space between the drum rear plate 220 and the duct portion 423. The second seal 452 may prevent hot air from leaking radially inwards from the space between the drum rear plate 220 and the duct portion 423.

The sealing portion 450 may be disposed on the radially outer side and the radially inner side of the suction hole 224, respectively. The first seal 451 may be provided on the radially outer side of the suction hole 224, and the second seal 452 may be provided on the radially inner side of the suction hole 224.

The sealing portion 450 may be brought into contact with both the drum rear plate 220 and the rear plate 420 in order to prevent hot air from leaking out. Because the drum 200 rotates during the operation of the laundry treatment apparatus, friction is continuously applied to the sealing portion 450 by the drum rear plate 220. For this reason, the sealing portion 450 may be made of a material capable of sealing between the drum rear plate 220 and the duct portion 423 without deteriorating performance even with frictional force and frictional heat generated by rotation.

The rear plate 420 may have the rear to which the motor portion 500 or the reducer 600 is coupled. The rear plate 420 may be a thin steel plate, and thus the rear plate 420 may be bent or deformed by the load of the reducer 600 and the load transmitted to the reducer 600 by the drum 200. For this reason, the rigidity of the rear plate 420 needs to be secured in order to install the reducer 600 and the motor portion 500 thereon. To this end, the rear plate 420 may further include a bracket 700 configured to reinforce coupling rigidity. The bracket 700 may be additionally coupled to the rear plate 420, and the reducer 600 and the motor portion 500 may be coupled to the rear plate 420 using the bracket 700.

The reducer 600 may be coupled to both the bracket 700 and the rear plate 420. The reducer 600, the rear plate 420, and the bracket 700 may all be coupled together using a reducer fastening member 681 (see FIG. 6). The rear plate 420 may be coupled to the bracket 700 so as to secure rigidity. The rear plate 420 in which rigidity is secured may have the driving portion coupled thereto.

Meanwhile, the reducer 600 may be coupled to the bracket 700 first, and then the bracket 700 may be coupled to the rear plate 420. In other words, the reducer 600 may be fixed to the rear plate 420 through the bracket 700 instead of being directly coupled to the rear plate 420.

When the driving portion is coupled to the rear of the rear plate 420, the motor portion 500 and the reducer 600 may be exposed to the outside. For this reason, the motor portion 500 or the reducer 600 needs to be prevented from being exposed. In addition, the duct portion 423 may be heated by hot air. Therefore, it may be necessary to insulate the rear surface of the duct portion 423. The rear cover 430 may be coupled to the rear of the rear plate 420 so as to prevent the duct portion 423 and the motor portion 500 or the reducer 600 from being exposed to the outside. The rear cover 430 may be spaced apart from the duct portion 423 and the driving portion. The rear cover 430 may prevent the motor portion 500 from being damaged due to external interference or may prevent reduction in drying efficiency due to heat loss occurring due to the duct portion 423.

FIGS. 5A and 5B illustrate the exterior of the reducer according to an embodiment of the present disclosure. FIG. 5A is a perspective view viewed from the front, and FIG. 5B is a perspective view viewed from the rear.

The reducer 600 may include a reducer housing defining the exterior. The reducer housing may include a first housing 610 facing the drum 200 (see FIG. 4) and a second housing 620 facing the motor portion 500 (see FIG. 4).

The reducer 600 may include a gear assembly. The gear assembly may receive power from the motor portion 500, reduce the RPM of the motor portion 500 but increase the torque value, and transmit the same to the drum 200. Most of the gear assembly is accommodated inside the second housing 620, and the first housing 610 may shield the inside of the reducer 600. As a result, the overall thickness of the reducer 600 may be reduced. The detailed structure of the gear assembly will be described later.

The first housing 610 may include a first housing blocking body 611 configured to shield the second housing 620, and a first housing bearing 612 extending from the first housing blocking body 611 in a direction away from the second housing 620. The first housing bearing 612 may accommodate and rotatably support the drum rotating shaft 6341.

The first housing 610 may include a stator coupling portion 613 configured to support the motor portion 500. The stator coupling portion 613 may extend from the circumferential surface of the first housing blocking body 611 in a direction away from the first housing bearing 612.

The stator coupling portion 613 may include a stator coupling groove 615 to which the motor portion 500 may be fastened. The stator coupling groove 615 may be recessed in the stator coupling portion 613. The stator coupling groove 615 may have a separate fastening member 617 (see FIGS. 6 and 9) inserted thereinto. The stator coupling portion 613 may be coupled to the motor portion 500 using the fastening member 617.

The first housing 610 may further include a coupling guide 614 configured to guide coupling of the motor portion 500. The coupling guide 614 may extend from the circumferential surface of the first housing blocking body 611 in a direction away from the first housing bearing 612. The coupling guide 614 may extend from the first housing blocking body 611 so as to be connected to the stator coupling portion 613. The coupling guide 614 may guide the position of the stator 510 (see FIGS. 4, 6, and 9) when the stator 510 is coupled to the stator coupling portion 613. Accordingly, assemblability may be improved.

The second housing 620 may accommodate the gear assembly. The second housing 620 may include a second housing coupling body 621 coupled to the first housing 610, a second housing blocking body 622 extending from the second housing coupling body 621 in a direction away from the first housing 610 so as to define a space in which the gear assembly is accommodated, and a second housing bearing 623 extending from the inner circumferential surface of the second housing blocking body 622 in a direction away from the first housing 610 so as to support the driving shaft 530.

The center of the first housing 610 may be designed to be disposed coaxially with the center of the second housing 620. The first housing bearing 612 configured to rotatably support the drum rotating shaft 6341 and the second housing bearing 623 configured to rotatably support the driving shaft 530 may be coaxially coupled to each other.

The driving shaft 530 may be inserted into the second housing 620 and rotatably supported inside the second housing 620. The washer portion 540 coupled to the rotor 520 may be coupled to the driving shaft 530. The washer portion 540 may include a receiving body 542 having a center having formed therein a shaft support hole 543 in which the driving shaft 530 is accommodated, and a washer coupling body 541 extending radially from the outer circumferential surface of the receiving body 542 so as to define a surface to which the rotor 520 is coupled. The washer coupling body 541 may have a disk shape. The shaft support hole 543 may have a groove shape corresponding to a protrusion, the protrusion being formed on the outer circumferential surface of the driving shaft 530, so that the protrusion may be coupled to the shaft support hole 543.

The washer portion 540 may include one or more washer coupling protrusions 5411 protruding from the washer coupling body 541 in a direction away from the reducer 600. The washer coupling protrusion 5411 may be coupled to a receiving groove (not shown) formed in the rotor 520.

The washer portion 540 may include one or more washer coupling holes 5412 passing through the washer coupling body 541. The washer coupling hole 5412 may be used to couple the rotor 520 to the washer portion 540 in a manner that a fastening member (not shown) penetrating the rotor 520 is inserted into the washer coupling hole 5412.

The washer coupling protrusion 5411 and the washer coupling hole 5412 may be alternately positioned in the circumferential direction on the surface of the washer coupling body 541 and may each be provided in plural.

FIG. 6 is an enlarged view of the inside of the dotted line in FIG. 3, and is a structure according to a first embodiment. The driving portion includes the motor portion 500 and the reducer 600. The motor portion 500 generates rotational power. The reducer 600 reduces the rotation speed of the motor portion 500 and transmits the same to the drum 200. The reducer 600 may include the drum rotating shaft 6341 configured to rotate the drum 200.

The motor portion 500 may include the stator 510 and the rotor 520. The stator 510 receives external power and generates a rotating magnetic field. The rotor 520 is rotated by the rotating magnetic field of the stator 510. The rotor 520 includes a permanent magnet. In an embodiment, the rotor 520 may be provided at a position surrounding the outer circumferential surface of the stator 510. The permanent magnet of the rotor 520 may be disposed on the inner circumferential surface of the rotor 520. The permanent magnet of the rotor 520 may be fixed to the inner circumferential surface of the rotor 520. The permanent magnet located on the inner circumferential surface of the rotor 520 may move in a predetermined direction by the rotating magnetic field generated by the stator 510. The rotor 520 rotates by the permanent magnet and the rotating magnetic field.

The rotor 520 may have a rotational center to which the driving shaft 530, configured to transmit rotational power of the rotor 520 while rotating together with the rotor 520, is coupled. The driving shaft 530 may rotate together with the rotor 520.

The driving shaft 530 may be coupled to the rotor 520 through the washer portion 540. The driving shaft 530 may be directly connected to the rotor 520. However, when connected through the washer portion 540, the driving shaft 530 may be more firmly coupled to the rotor 520, so that the rotational force of the rotor 520 may be more effectively transmitted. In addition, a load being intensively applied to the driving shaft 530 may be prevented, thereby increasing durability of the driving shaft 530.

A gear assembly 630 may include a ring gear 633 installed along the inner circumferential surface of the second housing blocking body 622. The ring gear 633 may have an inner circumferential surface provided with one or more planetary gears 632 gear-engaged with the ring gear 633, and may have an inner side provided with a sun gear 631 gear-engaged with the planetary gear 632 and rotating together with the driving shaft 530.

The sun gear 631 may rotate by being coupled to the driving shaft 530. The sun gear 631 may be provided as a separate member from the driving shaft 530, but is not limited thereto. The sun gear 631 may be integrated with the driving shaft 530.

The sun gear 631, the planetary gear 632, and the ring gear 633 may be provided as helical gears. When each gear is provided as a helical gear, noise may be reduced and power transmission efficiency may be increased. The sun gear 631, the planetary gear 632, and the ring gear 633 may also be provided as spur gears.

As an example of operation of the gear assembly 630, when the driving shaft 530 and the sun gear 631 connected to the driving shaft 530 rotate as the rotor 520 rotates, the planetary gear 632 gear-engaged with the outer circumferential surface of the sun gear 631 may rotate by being gear-engaged between the ring gear 633 and the sun gear 631.

The planetary gear 632 may include a planetary gear shaft 6323 inserted into the center of rotation. The planetary gear shaft 6323 may rotatably support the planetary gear 632. The reducer 600 may further include a first carrier 6342 and a second carrier 6343 configured to support the planetary gear shaft 6323. The planetary gear shaft 6323 may be supported by the second carrier 6343 at the front and supported by the first carrier 6342 at the rear.

The drum rotating shaft 6341 may extend from the rotational center of the second carrier 6343 in a direction away from the motor portion 500. The drum rotating shaft 6341 may be provided as a separate component from the second carrier 6343 and may be coupled to the second carrier 6343 and rotate together therewith. Alternatively, the drum rotating shaft 6341 may extend from the second carrier 6343 and be integrated with the second carrier 6343.

The drum rotating shaft 6341 may be coupled to the drum 200 so as to rotate the drum 200. As described above, the drum rotating shaft 6341 may be coupled to the drum 200 using a connecting body such as the driving shaft coupling portion 300, or may be directly coupled to the drum 200 without a separate connecting body.

The first housing bearing 612 may have an inner circumferential surface provided with a first bearing 660 and a second bearing 670 press-fitted thereto so as to rotatably support the drum rotating shaft 6341.

The first housing 610 and the second housing 620 may be coupled to each other through a reducer fastening member 681. The reducer fastening member 681 may pass through both the first housing 610 and the second housing 620 so as to couple the first housing 610 to the second housing 620. In addition, the reducer fastening member 681 may penetrate the first housing 610, the second housing 620, and the rear plate 420 so as to couple the first housing 610 to the second housing 620 and fix the reducer 600 to the rear plate 420.

The bracket 700 secures the rigidity of the rear plate 420 when the reducer 600 is coupled to the rear plate 420. The bracket 700 is made of a material having greater rigidity than the rear plate 420. The bracket 700 may be coupled to the front surface or to the rear surface of the rear plate 420.

The reducer 600 may be coupled to both the rear plate 420 and the bracket 700. In order to couple the rear plate 420, the bracket 700, and the reducer 600 to one another, a fastening member such as a bolt may be used. In addition, in order to fix the reducer 600 to the rear plate 420, the reducer fastening member 681 used to couple the first housing 610 to the second housing 620 may be used. In other words, the reducer fastening member 681 may pass through the second housing 620, the first housing 610, the rear plate 420, and the bracket 700 all at once so as to couple the same together. As another example, first, only the first housing 610 and the second housing 620 are coupled to each other using the reducer fastening member 681, and then the reducer 600 may be coupled to the rear plate 420 using a separate fastening member.

The first housing 610 may have a radially outer side provided with the stator coupling portion 613. The stator coupling portion 613 may have the motor portion 500 coupled thereto. The stator coupling portion 613 may include the stator coupling groove 615 recessed therein.

The stator 510 may be directly coupled to the rear plate 420, but may also be coupled to the stator coupling portion 613. The stator 510 may have an inner circumferential surface provided with a fixed rib 512 configured to support the stator 510. The fixed rib 512 may be coupled to the stator coupling portion 613. The fixed rib 512 may be coupled to the stator coupling portion 613 using the fastening member 617 such as a stator coupling pin.

There is a risk of the axial direction of the drum rotating shaft 6341 being distorted by the vibration of the drum 200. Because the motor portion 500 according to an embodiment is coupled to the first housing 610 configured to support the drum rotating shaft 6341, even if the axial direction of the drum rotating shaft 6341 is distorted, the axial direction of the driving shaft 530 will be similarly distorted by the first housing 610. Due to the coupling structure as described above, efficiency and reliability of transmitting power generated in the motor portion 500 to the drum 200 may be increased. In addition, wear of the gear assembly 630, reduction in power transmission efficiency, reduction in durability and reliability due to the deviation of the axes of the drum rotating shaft 6341 and the driving shaft 530 may be prevented.

The driving portion may be connected to the mounting plate 222. The drum rotating shaft 6341 of the driving portion is connected to the mounting plate 222 of the drum 200. The drum rotating shaft 6341 may have formed thereon first teeth 6346. The first teeth 6346 have a shape of an externally toothed wheel along the circumference of the drum rotating shaft 6341. The first teeth 6346 are exposed to the outside of the reducer 600.

FIGS. 7A-7C are perspective views of the mounting plate 222 according to an embodiment of the present disclosure. The mounting plate 222 and a filter layer 2229 will be described with reference to FIGS. 7A-7C, in addition to FIG. 6.

The mounting plate 222 includes a central portion 2223 and a flange portion 2224. The central portion 2223 has a center having formed therein a coupling hole 2227. The coupling hole 2227 has a circumference having formed thereon second teeth 2228. The second teeth 2228 have a shape of an internally toothed wheel. The second teeth 2228 mesh with the first teeth 6346.

The filter layer 2229 is made of a material that blocks leakage current. In an embodiment of the present disclosure, the filter layer 2229 may be provided on any one or more of the first teeth 6346 and the second teeth 2228. The filter layer 2229 may be coated on any one or more of the first teeth 6346 and the second teeth 2228. In the illustrated embodiment, a coating is formed on a portion of the second teeth 2228 in contact with the first teeth 6346 (see FIG. 7B). The filter layer 2229 is provided on a portion where the drum rotating shaft 6341 is brought into contact with the drum 200. In an embodiment, the filter layer 2229 may be provided on the second teeth 2228 of the mounting plate 222 constituting the drum 200. In a different embodiment, the filter layer 2229 may be provided on the first teeth 6346 of the drum rotating shaft 6341. The filter layer 2229 may be provided on one surface of opposite surfaces of the mounting plate 222 facing the drum 200 (see FIG. 7C). The filter layer 2229 may be formed in such a manner that the surface of the mounting plate 222 facing the drum 200 is coated with a coating material.

A material constituting the filter layer 2229 has a resistance of $10^6$ ohm or above and $10^9$ ohm or less. In other words, a material constituting the filter layer 2229 has a resistance of greater than $10^6$ ohms and less than $10^9$ ohms. The filter layer 2229 blocks leakage current leaked from the driving portion from being introduced into the drum 200, and discharges static electricity accumulated in the drum 200 due to rotation of the drum 200. In specifying the scope of the present disclosure, it has been described that the resistance is $10^6$ ohm or above and $10^9$ ohm or less, but this does not mean that the same is mathematically and physically within the exact numeral range. The range substantially the same or equivalent thereto that may implement the function of the present disclosure and circumvent the scope of the present disclosure should also be viewed as encompassed by the claims.

The inventors of the present disclosure found that leakage current flows to the surface of the drum 200 because there is no insulation established between the driving portion and the drum 200. Leakage current transmitted to the drum 200 is accumulated in the laundry, leading to a problem in that the current is felt when a user touches the laundry. The inventors of the present disclosure recognized the problem and insulated the drum 200 so that leakage current does not flow, but further recognized a problem that static electricity generated by rotation of the drum 200 is not discharged due to the insulation. In other words, the inventors of the present disclosure recognized that electric separation between the driving portion connected to the cabinet 100 and the drum 200 is necessary to prevent leakage current measured in the cabinet 100 from entering the drum 200, and have further recognized a problem in that static electricity generated by rotation of the drum 200 cannot be removed when the drum 200 is insulated from the driving portion for electric separation.

The inventors of the present disclosure recognized the need to block leakage current transmitted from the driving portion to the drum 200 while discharging static electricity accumulated in the drum 200 due to the rotation of the drum 200, and focused on charging depending on resistance so as to solve the problem. [Table 1] below is a table showing charging depending on resistance.

TABLE 1

| CHARGING DEPENDING ON RESISTANCE | |
|---|---|
| SURFACE RESISTIVITY (Ω: ohm) | CHARGING |
| $10^{13}$ or above | Large charge builds up. |
| $10^{13}$-$10^{12}$ | Attenuated very slowly after charging. |
| $10^{12}$-$10^{10}$ | Attenuated immediately after charging. |
| $10^{9}$-$10^{6}$ | Almost not charged. |
| $10^{6}$ or less | Not charged at all. |

The inventors of the present disclosure coated a material having a resistivity of $10^6$ ohm or above and $10^9$ ohm or less on a portion where the driving portion is connected to the drum 200. A material having a resistivity of $10^6$ ohm or less is too conductive, and thus cannot block leakage current. When a material has a resistivity of $10^9$ ohm or above, the material is too non-conductive and electricity does not flow, so static electricity is not discharged. The inventors of the present disclosure recognized that when the resistivity is $10^9$ to $10^6$ ohm, leakage current flowing into the drum 200 is blocked, and static electricity generated by rotation of the drum 200 is discharged. In an embodiment, the conductive polymer may be provided as a material having a resistivity of $10^6$ ohm or above and $10^9$ ohm or less. The conductive polymer may include polyamide. The conductive polymer may include poly(3,4-ethyleneioxythiophene).

The conductive polymer may be provided together with urethane. A material composed of conductive polymer and urethane has a hard surface, is resistant to scratches, and has excellent abrasion resistance and heat resistance. In addition, the material may be applied to a surface using a dipping method or a spray method. When the filter layer 2229 is broken, leakage current may occur again, so the material having excellent abrasion resistance and heat resistance may be used.

The filter layer 2229 may be coated on any one or more of the first teeth 6346 and the second teeth 2228. In the illustrated embodiment, the filter layer 2229 is coated on the second teeth 2228. The filter layer 2229 may also be provided at a portion where the mounting plate 222 is brought into contact with the driving shaft coupling portion 300. In other words, the filter layer 2229 may be coated on any one or more of the mounting plate 222 and the driving shaft coupling portion 300. In the embodiment illustrated in FIG. 7B, the filter layer 2229 is coated on a portion where the mounting plate 222 is brought into contact with the drive shaft coupling portion 300.

As in the embodiment illustrated in FIG. 6, the filter layer 2229 may be provided at least at a portion where the mounting plate 222 is brought into contact with the circumferential plate 221. Because the filter layer 2229 prevents leakage current of the mounting plate 222 from being transmitted to the circumferential plate 221, transmission of leakage current to the laundry inside the drum 200 is blocked.

As in the embodiment illustrated in FIG. 7C, the filter layer 2229 may be provided on at least one surface of the drum rear plate 220 facing the inner surface of the drum 200. In an embodiment, the filter layer 2229 is provided on one surface of the mounting plate 222 facing the inner surface of the drum 200. Because the one surface facing the inner surface of the drum 200 comes into contact with the driving shaft coupling portion 300, the filter layer 2229 provided on a surface facing the inner surface of the drum 200 may block leakage current. In addition, in an embodiment, because one surface of the mounting plate 222 facing the inner surface of the drum 200 may be coupled to the circumferential plate 221 by being brought into contact with the circumferential plate 221, the filter layer 2229 is provided on the one surface of the mounting plate 222 facing the drum 200 so that leakage current may be blocked. The filter layer 2229 may also be provided on another surface of opposite surfaces of the mounting plate 222 facing the driving portion. In an embodiment, the filter layer 2229 may be coated on the entire surface of the mounting plate 222 by a dipping process in the process of forming the filter layer 2229.

The filter layer 2229 may be applied to the surface using a dipping method, a spray method, or the like. In an embodiment, the filter layer 2229 may be formed by preparing the mounting plate 222 and dipping the mounting plate 222 in the above-described material. Alternatively, the filter layer 2229 may be formed by preparing the mounting plate 222 and spraying the above-described material on the mounting plate 222. The dipping method may be advantageous in forming the filter layer 2229 on the entire surface of the mounting plate 222. The spray method may be advantageous in forming the filter layer 2229 on one surface of the mounting plate 222.

In an embodiment, both the mounting plate 222 and the drum rotating shaft 6341 may be conductors. For example, the mounting plate 222 and the drum rotating shaft 6341 may be made of steel. Because the mounting plate 222 is a component to receive rotational force from the drum rotating shaft 6341, rigidity thereof needs to be high. Therefore, the mounting plate 222 may be selected from a material having high rigidity. When the mounting plate 222 is a conductor having high rigidity, there is the problem of leakage current described above, but according to an embodiment of the present disclosure, leakage current may be blocked by the filter layer 2229.

The flange portion 2224 of the mounting plate 222 has formed therein a through hole 2225 through which a fastening member 2221 passes. The flange portion 2224 is in surface contact with the circumferential plate 221. The fastening member 2221 couples the flange portion 2224 of the mounting plate 222 to the circumferential plate 221.

FIG. 8 illustrates the base 800 and the rear plate 420 according to an embodiment of the present disclosure. Hereinafter, the same will be described with reference to FIG. 8.

The duct portion 423 may include an inlet portion 4233 and a flow portion 4231. The inlet portion 4233 is located at the rear of the circulation flow portion 820. The flow portion 4231 is located at the rear of the drum 200.

The flow portion 4231 may accommodate a portion of the drum 200. The flow portion 4231 may partially accommodate the drum 200 so as to form a flow passage at the rear of the drum 200. The flow portion 4231 may have an annular shape so as to face the suction hole 224 formed in the drum rear plate 220. The flow portion 4231 may be recessed in the rear panel 421. In other words, the flow portion 4231 may have the front open, and may form a flow passage together with the rear surface of the drum 200. The flow portion 4231 may include a flow outer circumferential portion 4231*a* configured to surround the inner space, in which hot air flows, from the outside. The flow portion 4231 may include a flow inner circumferential portion 4231*b* configured to surround the inner space, in which hot air flows, from the inside. The flow outer circumferential portion 4231*a* may define the outer circumference of the flow portion 4231, and the flow inner circumferential portion 4231*b* may define the inner circumference of the flow portion 4231.

The flow portion 4231 may include a flow recessed surface 4232 defining the rear surface of the flow passage through which hot air moves. The flow recessed surface 4232 may connect the flow outer circumferential portion 4231*a* to the flow inner circumferential portion 4231*b*. In other words, the flow inner circumferential portion 4231*b*, the flow outer circumferential portion 4231*a*, and the flow recessed surface 4232 may define a space through which hot air discharged from the circulation flow portion 820 flows. In addition, the flow recessed surface 4232 may prevent hot air from leaking to the rear, but instead, may guide the same towards the drum 200. In other words, the flow recessed surface 4232 may be a recessed surface in the flow portion 4231.

The rear plate 420 may further include the mounting portion 425. The mounting portion 425 may be located on the radially inner side of the flow portion 4231. The mounting portion 425 may provide a space to which the reducer 600 or the motor portion 500 is coupled. The mounting portion 425 may have a radially outer side provided with the flow portion 4231 having an annular shape.

The inlet portion 4233 may be located to face the circulation flow portion 820. The inlet portion 4233 may be located to face the blower 8231. The inlet portion 4233 may be rearwardly recessed from the rear panel 421 in order to prevent interference with the blower 8231. The inlet portion 4233 may have an upper side connected to the flow portion 4231. The laundry treatment apparatus according to an embodiment of the present disclosure may include the connector 850 connected to the blower 8231. The connector 850 may guide hot air discharged from the blower 8231 to the flow portion 4231. The connector 850 may have formed therein a flow passage so as to guide hot air discharged from the blower 8231 to the flow portion 4231. The connector 850 may have formed therein a flow passage configured to interconnect the blower 8231 and the flow portion 4231. The flow passage formed in the connector 850 may have a cross-sectional area increasing as the distance from the blower 8231 increases.

The connector 850 may be located to face the inlet portion 4233. The inlet portion 4233 may be recessed rearwards so as to prevent interference with the connector 850. In addition, the connector 850 may have an upper end configured to divide the flow portion 4231 from the inlet portion 4233. In other words, hot air discharged from the connector 850 may be introduced into the flow portion 4231, but may be prevented from being introduced into the inlet portion 4233.

The connector 850 may evenly supply hot air to the flow portion 4231. The connector 850 may have a width increasing as the distance from the blower 8231 increases. The upper end of the connector 850 may be positioned along a circumferential extension line of the flow outer circumferential portion 4231*a*.

Accordingly, the hot air discharged from the connector 850 may be supplied to the entire flow portion 4231 without being moved to the inlet portion 4233. The connector 850 prevents hot air from being concentrated on one side of the flow portion 4231 so that the hot air is evenly supplied into the drum 200.

Because the connector 850 has a width increasing towards the upstream side, the speed of the hot air moving along the connector 850 decreases while moving in the flow direction. In other words, the connector 850 may perform a function of a diffuser configured to adjust the speed of hot air. The connector 850 decreases the speed of hot air so as to prevent the hot air from being intensively supplied to only a specific portion of the drum 200.

Due to the shape of the connector 850 described above, the inlet portion 4233 facing the connector 850 and configured to prevent interference with the connector 850 may also have a width increasing as the distance from the blower 8231 increases. Due to the shape of the inlet portion 4233, the entire duct portion 423 may have a shape of "9" when viewed from the front.

Because the drum 200 is configured to rotate during the drying operation, the drum 200 may be spaced apart from the flow portion 4231 by a predetermined distance. Through the space between the drum 200 and the flow portion 4231, hot air may leak out.

For this reason, the laundry treatment apparatus may further include the sealing portion 450 configured to prevent hot air from leaking into the space between the drum 200 and the flow portion 4231 (see FIG. 4). The sealing portion 450 may be positioned along the circumference of the flow portion 4231.

The first seal 451 may be provided along the outer circumference of the flow portion 4231. The first seal 451 may be provided between the drum 200 and the outer circumference of the flow portion 4231. In addition, the first seal 451 may be brought into contact with both the drum rear plate 220 and the rear plate 420 so as to further effectively prevent leakage. The first seal 451 may be brought into contact with the front surface of the connector 850. In addition, the first seal 451 may be brought into contact with the upper end of the connector 850. The connector 850 and the flow portion 4231 may form a flow passage through which hot air flows. Accordingly, the first seal 451 is provided to come into contact with the connector 850 so as to prevent hot air from leaking to the space between the drum 200 and the connector 850.

The second seal 452 may be provided along the inner circumference of the flow portion 4231. The second seal 452 may be provided between the drum 200 and the inner circumference of the flow portion 4231. In addition, the second seal 452 may be brought into contact with both the drum rear plate 220 and the rear plate 420. The second seal 452 may prevent hot air moving through the flow portion 4231 from leaking towards the mounting portion 425.

Because the drum 200 rotates during the operation of the laundry treatment apparatus, friction is continuously applied to the sealing portion 450 by the drum rear plate 220. For this reason, the sealing portion 450 may be made of a material capable of sealing between the drum rear plate 220 and the flow portion 4231 without deteriorating performance even with frictional force and frictional heat generated by rotation.

FIG. 9 is an enlarged view of the inside of the dotted line in FIG. 3, and is a structure according to a second embodiment. Hereinafter, the same will be described with reference to FIG. 9. In the description below, only portions different from those of the first embodiment illustrated in FIG. 6 will be described.

The flange portion 2224 of the mounting plate 222 has formed therein a through hole through which the fastening member 2221 passes. The flange portion 2224 is in surface contact with the circumferential plate 221. The flange portion 2224 of the mounting plate 222 is coupled to the circumferential plate 221 using the fastening member 2221. The flange portion 2224 and the circumferential plate 221 have an electrical insulating layer 2215 provided therebetween.

In an embodiment, both the mounting plate 222 and the circumferential plate 221 may be conductors. For example, the mounting plate 222 may be made of steel, and the circumferential plate 221 may be made of stainless steel. Because the mounting plate 222 is a component to receive rotational force from the drum rotating shaft 6341, rigidity thereof needs to be high. Therefore, the mounting plate 222 may be selected from a material having high rigidity. When the mounting plate 222 and the circumferential plate 221 are conductors, there is a problem of leakage current described above. However, according to an embodiment of the present disclosure, the electrical insulating layer 2215 blocks leakage current transmitted to the drum 200 through the drum rotating shaft 6341 of the drive portion. More specifically, the mounting plate 222 is covered by the cover member 229 and does not come into contact with the laundry accommodated in the drum 200, but the circumferential plate 221 comes into contact with the laundry, so that the current of the circumferential plate 221 may be transmitted to the laundry. According to an embodiment of the present disclosure, the mounting plate 222 and the circumferential plate 221 have the electrical insulating layer 2215 provided therebetween, so that the mounting plate 222 is electrically insulated from the circumferential plate 221. In other words, because a portion of the driving portion to which the drum 200 is connected is electrically insulated by the electrical insulating layer 2215, a problem that leakage current is transmitted to laundry and thus causes a user discomfort may be solved. The fastening member 2221 configured to couple the mounting plate 222 to the circumferential plate 221 may be provided with an electrical insulator 2222. The electrical insulator 2222 may be provided as an insulating ring, and may be fitted to the fastening member 2221. The electrical insulator 2222 may block leakage current from being transmitted to the circumferential plate 221 through the fastening member 2221.

FIG. 10 is a perspective view of the mounting plate 222 according to an embodiment of the present disclosure. According to an embodiment, the electrical insulating layer 2215 may be coated on the flange portion 2224 of the mounting plate 222.

FIG. 11 is a front perspective view of a structure in which the rear plate 420 and the base 800 of the laundry treatment apparatus according to the second embodiment of the present disclosure are coupled to each other. Hereinafter, the same will be described with reference to FIG. 11. In the description below, only portions different from those of the first embodiment illustrated in FIG. 8 will be described.

The laundry treatment apparatus according to the second embodiment includes a grounding member 1000. The grounding member 1000 may be coupled to the upper end of the rear plate 420. The rear plate 420 may have formed therein a through hole for assembly, and the grounding member 1000 may be screwed through the through hole in the rear plate 420. The grounding member 1000 forms an electric passage between the cabinet 100 and the drum 200.

FIG. 12A illustrates a grounding member 1000-1 according to the first embodiment of the present disclosure.

The grounding member 1000-1 according to the first embodiment includes a filter member 1200, a drum contact end 1100, and a cabinet contact end 1300. The filter member 1200 has one end that is the drum contact end 1100, and has another end that is the cabinet contact end 1300.

The filter member 1200 is made of a material that blocks leakage current but discharges static electricity. The inventors of the present disclosure found that leakage current flows to the surface of the drum 200 because there is no insulation established between the driving portion and/or the cabinet 100 and the drum 200. Leakage current transmitted to the drum 200 is accumulated in the laundry, leading to a problem in that the current is felt when a user touches the laundry. The inventors of the present disclosure recognized the problem and insulated the drum 200 so that leakage current does not flow, but further recognized a problem that static electricity generated by rotation of the drum 200 is not discharged due to the insulation. Specifically, the inventors of the present disclosure recognized that electric separation between the driving portion connected to the cabinet 100 and the drum 200 is necessary to prevent leakage current measured in the cabinet 100 from entering the drum 200, and have further recognized a problem in that static electricity generated by rotation of the drum 200 cannot be removed when the drum 200 is insulated from the driving portion for electric separation.

The grounding member 1000 is provided as a component to solve the above mentioned problem. The grounding member 1000 is provided as the filter member 1200 in which at least a portion defining an electric passage blocks leakage current. The term "blocking leakage current" used in this specification not only includes the expression "completely blocking leakage current by 100%" but also includes the expression "reducing the inflow of leakage current." In other words, the expression "reducing the inflow of leakage current to 50% or less" may be used as the expression "blocking leakage current" in the present disclosure.

The inventors of the present disclosure recognized the need to block leakage current transmitted from the driving portion to the drum 200 while discharging static electricity accumulated in the drum 200 due to the rotation of the drum 200, and focused on charging depending on resistance so as to solve the problem. The filter member 1200 having a resistance of $10^6$ ohm or above and $10^9$ ohm or less is provided (see Table 1). In specifying the scope of the present disclosure, it has been described that the resistance is $10^6$ ohm or above and $10^9$ ohm or less, but this does not mean that the same is mathematically and physically within the exact numeral range. The range substantially the same or equivalent thereto that may implement the function of the present disclosure and circumvent the scope of the present disclosure should also be viewed as encompassed by the claims.

Leakage current from the cabinet 100 transmitted to the drum 200 is blocked by the filter member 1200, and static electricity accumulated in the drum 200 due to rotation of the drum 200 is discharged to the cabinet 100. The inventors of the present disclosure allowed the filter member 1200 having a resistivity of $10^6$ ohm or above and $10^9$ ohm or less to form at least a portion of the electric passage so as to electrically connect the cabinet 100 to the drum 200. A material having a resistivity of $10^6$ ohm or less is too conductive, and thus cannot block leakage current. When a material has a resistivity of $10^9$ ohm or above, the material is too non-conductive and electricity does not flow, so static electricity is not discharged. The inventors of the present disclosure recognized that when the resistivity is $10^9$ to $10^6$ ohm, leakage current flowing into the drum 200 is blocked, and static electricity generated by rotation of the drum 200 is discharged.

In an embodiment, ethylene-propylene diene monomer (EPDM) may be provided as a material having a resistivity of $10^6$ ohm or above and $10^9$ ohm or less. In addition to EPDM, a conductive polymer may be provided as a material having a resistivity of $10^6$ ohm or above and $10^9$ ohm or less. The conductive polymer may include polyamide. The conductive polymer may include poly(3,4-ethyleneioxythiophene).

The drum contact end 1100 extends from the filter member 1200. The drum contact end 1100 may be a metal brush 1110. The drum contact end 1100 may be composed of a plurality of thin wires. Because the drum contact end 1100 must continuously be in contact with the rotating drum 200, the drum contact end 1100 may be worn due to rotational friction. For this reason, the drum contact end 1100 may have excellent abrasion resistance and heat resistance. In addition, because the drum contact end 1100 should be kept in contact with the drum 200 for a long time to increase the electrostatic dissipation effect, the position of the drum contact end 1100 may be fixed. A brush 1110 made of metal satisfies the above-mentioned conditions, and has good abrasion resistance, heat resistance, and fixability, so that the metal brush 1110 may effectively discharge static electricity. The brush 1110 may be surrounded by surrounding member 1120. The surrounding member 1120 may bind plurality of thin wires of the metal brush 1110. The surrounding member 1120 may be provided as an electrical insulating material.

The cabinet contact end 1300 extends from the filter member 1200. The cabinet contact end 1300 may be provided as a washer portion having formed therein a coupling hole 1310. The cabinet contact end 1300 may be easily coupled to the cabinet 100. The grounding member 1000-1 may be coupled to the cabinet 100 using a fastening member (not shown) penetrating the coupling hole 1310.

FIG. 12B illustrates a grounding member 1000-2 according to the second embodiment of the present disclosure.

Unlike the grounding member 1000-1 according to the first embodiment, the grounding member 1000-2 according to the second embodiment may omit the washer portion provided at the cabinet contact end 1300. Although the washer portion facilitates coupling to the cabinet 100, the grounding member 1000-2 according to the second embodiment may be coupled to the cabinet 100 in such a manner that the filter member 1200 has formed therein a coupling hole 1210, and a fastening member (not shown) penetrates the coupling hole 1210.

FIG. 13 illustrates a coupling structure of the rear plate 420, the reducer 600, and the motor portion 500 according to an embodiment of the present disclosure. Hereinafter, the same will be described with reference to FIG. 13.

The reducer 600 may be supported by the rear plate 420, and the motor portion 500 may be coupled to the reducer 600. The rear plate 420 may support both the reducer 600 and the motor portion 500. The motor portion 500 and the reducer 600 may be located at the rear of the rear plate 420.

The reducer 600 may be installed on the rear plate 420 so as to be located inside the duct portion 423. The reducer 600 may be located on the radially inner side of the flow portion 4231 so that interference with the flow portion 4231 is prevented.

The gear assembly inside the reducer 600 may be damaged by the heat of the hot air moving along the flow portion 4231. For this reason, the flow portion 4231 may be spaced apart from the reducer 600 by a predetermined distance.

The reducer 600 may pass through the rear plate 420 so as to be coupled thereto. Therefore, the reducer 600 may be connected to the drum 200 located at the front of the rear plate 420.

The stator 510 may include a main body 511, the fixed rib 512, teeth 514, and a pole shoe 515.

The rotor 520 may include a rotor body 521 and an installation body 522. The permanent magnet may be disposed along the inner circumferential surface of the rotor body 521.

The installation body 522 may have formed therein a rotor coupling hole 526 provided at a position corresponding to the washer coupling hole 5412. The washer portion 540 may be coupled to the rotor 520 using a coupling member penetrating both the washer coupling hole 5412 and the rotor coupling hole 526 at once so as to be coupled thereto. The washer portion 540 may be coupled to the rotor 520 so as to rotate together therewith.

The installation body 522 may have formed therein a washer protrusion receiving hole 525 corresponding to the washer coupling protrusion 5411. The washer coupling protrusion 5411 may be inserted into the washer protrusion receiving hole 525 so as to support coupling between the washer portion 540 and the rotor 520.

The installation body 522 may have a center having formed therein a rotor installation hole 524. The rotor installation hole 524 may receive the receiving body 542. The washer portion 540 may rotate together with the driving shaft 530 by the rotor 520 and may firmly support coupling between the driving shaft 530 and the rotor 520. Therefore, durability and reliability of the entire motor portion 500 may be secured.

Although the preferred embodiments of the present disclosure have been disclosed for illustrative purposes, those skilled in the art will appreciate that various modifications, additions and substitutions are possible, without departing from the scope and spirit of the disclosure as disclosed in the accompanying claims.

The invention claimed is:

1. A laundry treatment apparatus comprising:

a cabinet;

a drum rotatably provided in the cabinet and configured to accommodate laundry, having a cylindrical shape, having one side open so as to define an input opening, and having another side defining a drum rear plate; and a driving portion having a drum rotating shaft coupled to the drum rear plate so as to provide power to rotate the drum, wherein the laundry treatment apparatus further comprises a filter layer provided at a portion where the drum rotating shaft is brought into contact with the drum, and having a resistivity greater than $10^6$ ohm and less than $10^9$ ohm.

2. The laundry treatment apparatus according to claim 1, wherein:

the drum rotating shaft has formed thereon first teeth, the drum rear plate has formed thereon second teeth meshing with the first teeth, and the filter layer is provided on at least one of the first teeth and the second teeth.

3. The laundry treatment apparatus according to claim 1, wherein:

the drum rear plate is fastened to the drum rotating shaft using a fastening member, and the filter layer is provided on at least a portion where the fastening member is brought into contact with the drum rear plate.

4. The laundry treatment apparatus according to claim 1, wherein:

the drum rear plate further comprises a mounting plate coupled to the drum rotating shaft, and the filter layer is provided on the mounting plate.

5. The laundry treatment apparatus according to claim 4, wherein the drum rear plate further comprises:

a circumferential plate coupled to the mounting plate and defining a circumference of the drum rear plate, and wherein the filter layer is provided at least at a portion where the mounting plate and the circumferential plate come into contact with each other.

6. The laundry treatment apparatus according to claim 1, wherein the drum rear plate and the drum rotating shaft are conductors.

7. The laundry treatment apparatus according to claim 1, wherein the filter layer is provided on at least one surface of the drum rear plate facing an inner surface of the drum.

8. The laundry treatment apparatus according to claim 7, wherein the filter layer is further provided on at least another surface of the drum rear plate facing the driving portion.

9. The laundry treatment apparatus according to claim 1, wherein the filter layer contains a conductive polymer.

10. The laundry treatment apparatus according to claim 1, wherein the filter layer contains urethane and a conductive polymer.

11. A laundry treatment apparatus comprising:

a cabinet;

a drum rotatably provided in the cabinet and configured to accommodate laundry, having a cylindrical shape, having one side open so as to define an input opening, and having another side defining a drum rear plate;

a driving portion having a drum rotating shaft coupled to the drum rear plate so as to provide power to rotate the drum;

an electrical insulating layer provided on a portion where the driving portion is connected to the drum; and a grounding member having one end brought into contact with the drum and another end brought into contact with the cabinet, and comprising a filter member having at least a portion forming an electric passage having a resistivity of $10^6$ ohm or greater and $10^9$ ohm or less.

12. The laundry treatment apparatus according to claim 11, wherein the one end of the grounding member is implemented as a metal brush extending from the filter member.

13. The laundry treatment apparatus according to claim 11, wherein the one end of the grounding member is implemented as a wire composed of a plurality of strands extending from the filter member.

14. The laundry treatment apparatus according to claim 11, wherein:

the other end of the grounding member is provided with a washer portion, and the washer portion is coupled to the cabinet.

15. The laundry treatment apparatus according to claim 11, wherein the drum rear plate comprises:

a mounting plate coupled to the drum rotating shaft; and a circumferential plate coupled to the mounting plate and defining a circumference of the drum rear plate, and wherein the electrical insulating layer is provided at least at a portion where the mounting plate and the circumferential plate come into contact with each other.

16. The laundry treatment apparatus according to claim 15, wherein the mounting plate and the circumferential plate are conductors.

17. The laundry treatment apparatus according to claim 15, wherein the electrical insulating layer is coated on a surface of the circumferential plate.

18. The laundry treatment apparatus according to claim 16, wherein:

the mounting plate is fastened to the circumferential plate using a fastening member, and the fastening member is provided with an electrical insulator.

19. The laundry treatment apparatus according to claim 15, wherein:

the mounting plate has a circumference having formed thereon a flange portion, the flange portion is brought into contact with the circumferential plate, and the electrical insulating layer is provided at a portion where the flange portion is brought into contact with the circumferential plate.

20. The laundry treatment apparatus according to claim 11, wherein the cabinet comprises:

a front panel defining a front surface of an exterior of the cabinet;

an upper panel defining an upper surface of the exterior of the cabinet;

a side panel defining a side surface of the exterior of the cabinet; and a rear plate defining a rear surface of the cabinet, and wherein the other end of the grounding member is brought into contact with the rear plate.

* * * * *